US011082794B2

(12) United States Patent
Alon et al.

(10) Patent No.: US 11,082,794 B2
(45) **Date of Patent: *Aug. 3, 2021**

(54) COMPENSATING FOR EFFECTS OF HEADSET ON HEAD RELATED TRANSFER FUNCTIONS

(71) Applicant: Facebook Technologies, LLC, Menlo Park, CA (US)

(72) Inventors: David Lou Alon, Arugot D (IL); Maria Cuevas Rodriguez, Redmond, WA (US); Ravish Mehra, Tacoma, WA (US); Philip Robinson, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/006,280

(22) Filed: Aug. 28, 2020

(65) Prior Publication Data

US 2020/0396558 A1 Dec. 17, 2020

Related U.S. Application Data

(63) Continuation of application No. 16/562,616, filed on Sep. 6, 2019, now Pat. No. 10,798,515.

(Continued)

(51) Int. Cl.
*H04S 7/00* (2006.01)
*H04R 5/027* (2006.01)

(Continued)

(52) U.S. Cl.
CPC ..... *H04S 7/304* (2013.01); *H04R 1/403* (2013.01); *H04R 3/12* (2013.01); *H04R 5/027* (2013.01);

(Continued)

(58) Field of Classification Search
CPC ..... H04S 7/30; H04S 7/302; H04S 7/303; H04S 7/304; H04S 7/305; H04S 7/307;

(Continued)

(56) References Cited

U.S. PATENT DOCUMENTS 6,072,877 A * 6/2000 Abel ..... H04S 1/002 381/17
6,118,875 A 9/2000 Møller et al.

(Continued)

FOREIGN PATENT DOCUMENTS

WO WO 2015/134658 A1 9/2015

OTHER PUBLICATIONS

Geronazzo, M. et al. "Mixed Structural Modeling of Head-Related Transfer Functions for Customized Binaural Audio Delivery." 2013 18th International Conference on Digital Signal Processing (DSP), Jul. 1-3, 2013, pp. 1-8.

(Continued)

*Primary Examiner* — Leshui Zhang
(74) *Attorney, Agent, or Firm* — Fenwick & West LLP

(57) ABSTRACT

An audio system captures audio data of test sounds through a microphone of a headset worn by a user. The test sounds are played by an external speaker, and the audio data includes audio data captured for different orientations of the headset with respect to the external speaker. A set of head-related transfer function (HRTFs) is calculated based at least in part on the audio data of the test sounds at the different orientations of the headset. A portion of the set of HRTFs is discarded to create an intermediate set of HRTFs. The discarded portion corresponding to one or more distortion regions that are based in part on wearing the headset. One or more HRTFs are generated that correspond to the discarded portion using at least some of the intermediate set of HRTFs to create an individualized set of HRTFs for the user.

19 Claims, 11 Drawing Sheets

Related U.S. Application Data

(60) Provisional application No. 62/798,813, filed on Jan. 30, 2019.

(51) Int. Cl.

| | |
|---|---|
| ***H04R 1/40*** | (2006.01) |
| ***H04R 3/12*** | (2006.01) |
| ***H04S 1/00*** | (2006.01) |
| ***H04R 5/033*** | (2006.01) |

(52) U.S. Cl.
CPC ..... *H04S 7/301* (2013.01); *H04S 2400/11* (2013.01); *H04S 2400/15* (2013.01); *H04S 2420/01* (2013.01)

(58) Field of Classification Search
CPC ..... H04S 7/308; H04S 7/301; H04S 1/005; H04S 2420/01; H04S 2420/05; H04S 2420/07; H04S 2420/13; H04S 2400/07; H04S 2400/09; H04S 2400/15; H04S 2400/11; H04S 2400/00; H04S 2400/05; H04S 2400/13; H04S 1/002; H04R 3/005; H04R 3/12; H04R 1/1041; H04R 1/40; H04R 1/403; H04R 1/406; H04R 5/00; H04R 5/027; H04R 5/033; H04R 5/0335; H04R 5/04; H04R 3/00; H04R 3/04; H04R 3/06; H04R 3/08; H04R 3/14; H04R 1/32; H04R 1/34; H04R 1/345; H04R 1/347; H04R 1/36; H04R 1/38; H04R 2499/15; G06F 3/165
USPC ..... 381/300, 303, 304, 305, 309, 310, 311, 381/26, 56, 58, 59, 60, 61, 63, 66, 312, 381/313, 316, 320, 321, 74, 79, 71.1, 381/71.6, 92, 95, 97, 98, 99, 100, 101, 381/102, 103, 111, 112, 113, 114, 115, 381/120, 122; 700/94
See application file for complete search history.

(56) References Cited

U.S. PATENT DOCUMENTS

| | | | | |
|---|---|---|---|---|
| 8,428,269 | B1 | 4/2013 | Brungart et al. | |
| 9,392,366 | B1 * | 7/2016 | Meyer | H04R 25/505 |
| 9,544,706 | B1 | 1/2017 | Hirst | |
| 9,848,273 | B1 | 12/2017 | Helwani et al. | |
| 10,003,905 | B1 | 6/2018 | Milne et al. | |
| 10,028,070 | B1 | 7/2018 | Gamper et al. | |
| 10,034,092 | B1 | 7/2018 | Nawfal et al. | |
| 10,462,598 | B1 | 10/2019 | Villanueva-Barreiro et al. | |
| 10,638,251 | B2 | 4/2020 | Robinson et al. | |
| 2006/0056638 | A1 | 3/2006 | Schobben | |
| 2007/0223708 | A1 | 9/2007 | Villemoes et al. | |
| 2008/0137870 | A1 | 6/2008 | Nicol et al. | |
| 2009/0208022 | A1 | 8/2009 | Fukui et al. | |
| 2012/0328107 | A1 | 12/2012 | Nyström et al. | |
| 2013/0202117 | A1 | 8/2013 | Brungart et al. | |
| 2015/0010160 | A1 | 1/2015 | Udesen | |
| 2016/0044430 | A1 | 2/2016 | McGrath | |
| 2017/0208416 | A1 | 7/2017 | Petrov | |
| 2017/0332186 | A1 * | 11/2017 | Riggs | H04S 7/301 |
| 2018/0035226 | A1 | 2/2018 | Reijniers et al. | |
| 2018/0146318 | A1 | 5/2018 | Bilinski et al. | |
| 2018/0310115 | A1 | 10/2018 | Romigh | |
| 2019/0014431 | A1 | 1/2019 | Lee et al. | |
| 2019/0200159 | A1 | 6/2019 | Park et al. | |
| 2019/0208348 | A1 | 7/2019 | Reijniers et al. | |

OTHER PUBLICATIONS

Guillon, P. et al. "Head-Related Transfer Function Customization by Frequency Scaling and Rotation Shift Based on a New Morphological Matching Method." 125$^{th}$ Audio Engineering Society Convention, Oct. 2-5, 2008, pp. 1-14.

Hu, H. et al. "The Estimation of Personalized HRTFs in Individual VAS." 2008 Fourth International Conference on Natural Computation, Oct. 18-20, 2008, pp. 203-207.

PCT International Search Report and Written Opinion, PCT Application No. PCT/US2020/013539, dated Apr. 28, 2020, 12 pages.

Sunder, K. et al. "Individualization of Head-Related Transfer Functions in the Median Plane Using Frontal Projection Headphones." Journal of the Audio Engineering Society, vol. 64, No. 12, Dec. 2016, pp. 1026-1041.

* cited by examiner

COMPENSATING FOR EFFECTS OF HEADSET ON HEAD RELATED TRANSFER FUNCTIONS

CROSS REFERENCE TO RELATED APPLICATION

This application is a continuation of co-pending U.S. application Ser. No. 16/562,616, filed Sep. 6, 2019, which claims the benefit and priority of U.S. Provisional Application No. 62/798,813 filed Jan. 30, 2019, all of which are incorporated by reference herein in their entirety.

FIELD OF THE INVENTION

The present disclosure relates generally to head-related transfer functions (HRTFs) and specifically to compensating for effects of a headset on HRTFs.

BACKGROUND

Conventionally, head-related transfer functions (HRTF)s are determined in a sound dampening chamber for many different source locations (e.g., typically more than a 100) relative to a person. The determined HRTFs may then be used to provide spatialized audio content to the person. Moreover, to reduce error, it is common to determine multiple HRTFs for each source location (i.e., each speaker is generating a plurality of discrete sounds). Accordingly, for high quality spatialization of audio content it takes a relatively long time (e.g., more than an hour) to determine the HRTFs as there are multiple HRTFs determined for many different speaker locations. Additionally, the infrastructure for measuring HRTFs sufficient for quality surround sound is rather complex (e.g., sound dampening chamber, one or more speaker arrays, etc.). Accordingly, conventional approaches for obtaining HRTFs are inefficient in terms of hardware resources and/or time needed.

SUMMARY

Embodiments relate to a system and a method for obtaining an individualized set of HRTFs for a user. In one embodiment, a HRTF system determines a set of distortion regions, which are portions HRTFs where the sound is commonly distorted by the presence of a headset. The HRTF system captures audio test data for a population of test users, both with a headset on and with the headset off. The audio test data is used to determine sets of HRTFs. Analyzing and comparing sets of HRTFs of the test users with the headset and sets of HRTFs of the test users without the headset for the population of test users determines frequency-dependent and directionally-dependent regions of distorted HRTFs that are common for the population of test users.

An audio system of an artificial reality system compensates for the distortion of the set of HRTFs by accounting for the distortion regions. A user wears a headset equipped with means for capturing sounds in the user's ear canal (i.e., a microphone). The audio system plays test sounds through an external speaker and records audio data of how the test sounds are captured in the user's ear for different directional orientations with respect to an external speaker. For each measured direction, an initial HRTF is calculated, forming an initial set of HRTFs. The portions of the initial set of HRTFs corresponding to the distortion regions are discarded. The discarded regions are interpolated to calculate an individualized set of HRTFs that compensates for the headset distortion.

Figure 1A:
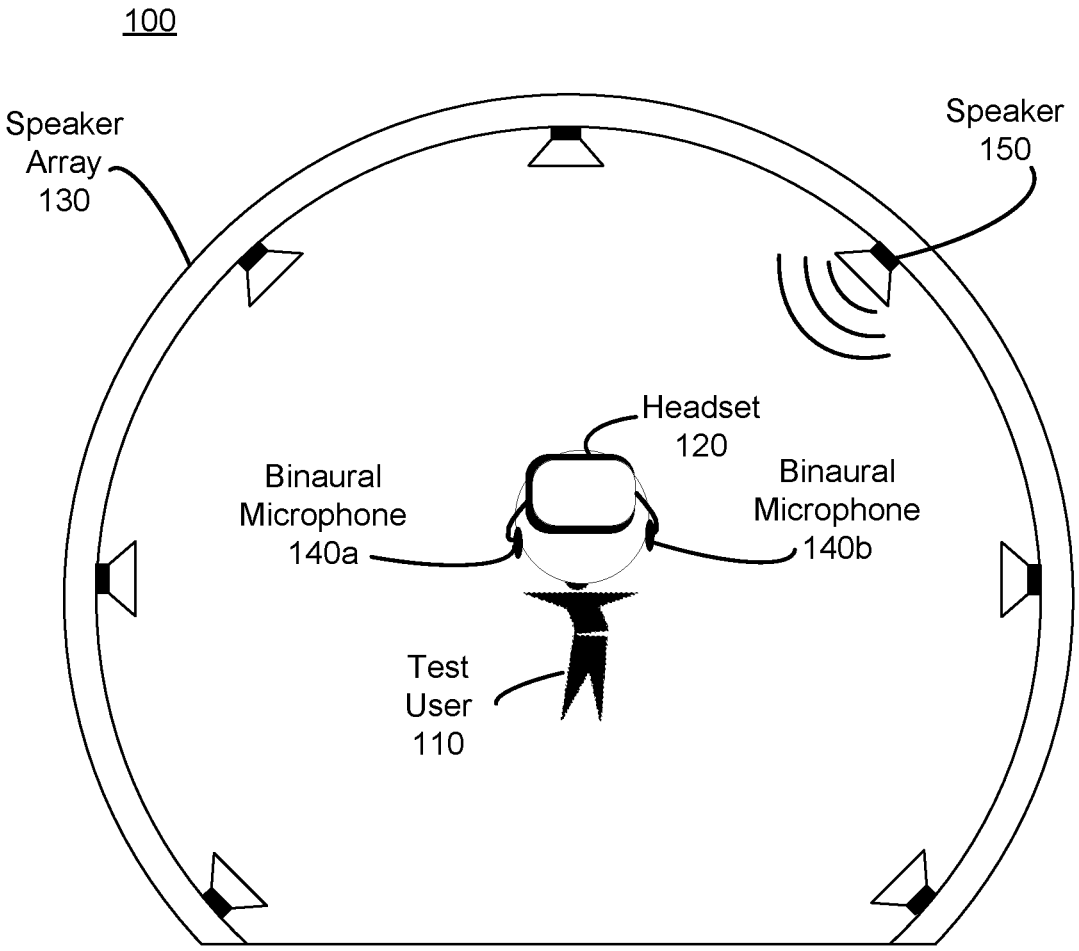
FIG. 1A is a diagram of a sound measurement system (SMS) for obtaining audio data associated with a test user wearing a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a headset connected to a host computer system, a standalone headset, a mobile device or computing system, or any other hardware platform capable of providing artificial reality content to one or more viewers.

Overview

An HRTF system herein is used to collect audio test data to determine common portions of HRTFs that are distorted by the presence of a headset. The HRTF system captures audio test data at a test user's ear canal in an acoustic chamber, both with the test user wearing a headset and without the headset. The audio test data is analyzed and compared to determine the effect of the presence of the headset on individualized HRTFs. The audio test data is collected for a population of test users and used to determine a set of distortion regions where the HRTFs are commonly distorted by the presence of the headset.

An audio system of a headset uses information from the HRTF system to calculate for a user a set of individualized HRTFs that compensate for the effects of the headset on the HRTFs. The user wears the headset and the audio system captures audio data of test sounds emitted from an external speaker. The external speaker may be, e.g., physically separate from the headset and audio system. The audio system calculates a set of initial HRTFs based at least in part on the audio data of the test sound at different orientations of the headset. The audio system discards a portion (based in part on at least some of the distortion regions determined by the HRTF server) of the set of initial HRTFs to create an intermediate set of HRTFs. The intermediate set of HRTFs is formed from the non-discarded HRTFs of the set of HRTFs. The discarded portion of the set of HRTFs corresponds to one or more distortion regions that are caused by the presence of the headset. The audio system generates one or more HRTFs (e.g., via interpolation) that correspond to the discarded portion of the set, which are combined with at least some of the intermediate set of HRTFs to create a set of individualized HRTFs for the user. The set of individualized HRTFs are customized to the user such that errors in the HRTFs caused by wearing the headset are mitigated, and thereby mimic actual HRTFs of the user without a headset. The audio system may use the set of individualized HRTFs to present spatialized audio content to the user. Spatialized audio content is audio that can be presented as if it is positioned at a specific point in three-dimensional space. For example, in a virtual environment, audio associated with a virtual object that is being displayed by the headset can appear to originate from the virtual object.

Note that in this manner, the audio system is effectively able to generate an individualized set of HRTFs for the user, even though the user is wearing the headset. This is much faster, easier, and cheaper than conventional methods of measuring a user's actual HRTFs in a customized sound dampening chamber.

Example Distortion Mapping System

FIG. 1A is a diagram of a sound measurement system (SMS) 100 for obtaining audio test data associated with a test user 110 wearing a headset 120, in accordance with one or more embodiments. The sound measurement system 100 is part of an HRTF system (e.g., as described below with regard to FIG. 2). The SMS 100 includes a speaker array 130, and a binaural microphones 140*a*, 140*b*. In the illustrated embodiment, the test user 110 is wearing the headset 120 (e.g., as described in more detail in relation to FIGS. 7A and 7B). The headset 110 may be called a test headset. The SMS 100 is used for measuring audio test data to determine a set of HRTFs for a test user 110. The SMS 100 is housed in an acoustically treated chamber. In one particular embodiment, the SMS 100 is anechoic down to a frequency of approximately 500 hertz (Hz).

In some embodiments, the test user 110 is a human. In these embodiments, it is useful to collect audio test data for a large number of different people. The people can different ages, different sizes, different genders, have different hair lengths, etc. In this manner audio test data can be collected over a large population. In other embodiments, the test user 110 is a manikin. The manikin may, e.g., have physical features (e.g., ear shape, size, etc.) representative of an average person.

The speaker array 130 emits test sounds in accordance with instructions from a controller of the SMS 100. A test sound is an audible signal transmitted by a speaker that may be used to determine a HRTF. A test sound may have one or more specified characteristics, such as frequency, volume, and length of the transmission. The test sounds may include, for example, a continuous sinusoidal wave at a constant frequency, a chirp, some other audio content (e.g., music), or some combination thereof. A chirp is a signal whose frequency is swept upward or downward for a period of time. The speaker array 130 comprises a plurality of speakers, including a speaker 150, that are positioned to project sound to a target area. The target area is where the test user 110 is located during operation of the SMS 100. Each speaker of the plurality of speakers is in a different location relative to the test user 110 in the target area. Note that, while the speaker array 130 is depicted in two-dimensions in FIG. 1, it is noted that the speaker array 130 can also include speakers in other locations and/or dimensions (e.g., span three-dimensions). In some embodiments, the speakers in the speaker array 130 are positioned spanning in elevation from −66° to +850 with a spacing of 9°-10° between each speaker 150 and spans every 10° in azimuth around a full sphere. That is, 36 azimuths and 17 elevations, creating a total of 612 different angles of speakers 150 with respect to the test user 110. In some embodiments, one or more speakers of the speaker array 130 may dynamically change their position (e.g., in azimuth and/or elevation) relative to the target area. Note in the above description the test user 110 is stationary (i.e., the position of the ears within the target area stays substantially constant).

The binaural microphones 140*a*, 140*b* (collectively referred to as "140") capture the test sounds emitted by the speaker array 130. The captured test sounds are referred to as audio test data. The binaural microphones 140 are each placed in an ear canal of the test user. As illustrated, the binaural microphone 140*a* is placed in the ear canal of the right ear of the user, and the microphone 140*b* is placed in the ear canal of the left ear of the user. In some embodiments, the microphones 140 are embedded in foam earplugs that are worn by the test user 110. As discussed in detail below with regard to FIG. 2, the audio test data can be used to determine a set of HRTFS. For example, test sounds emitted by a speaker 150 of the speaker array 130 are captured by the binaural microphones 140 as audio test data. The speaker 150 has a specific location relative to the ears of the test user 110, accordingly, there is a specific HRTF for each ear that can be determined using the associated audio test data.

Figure 1B:
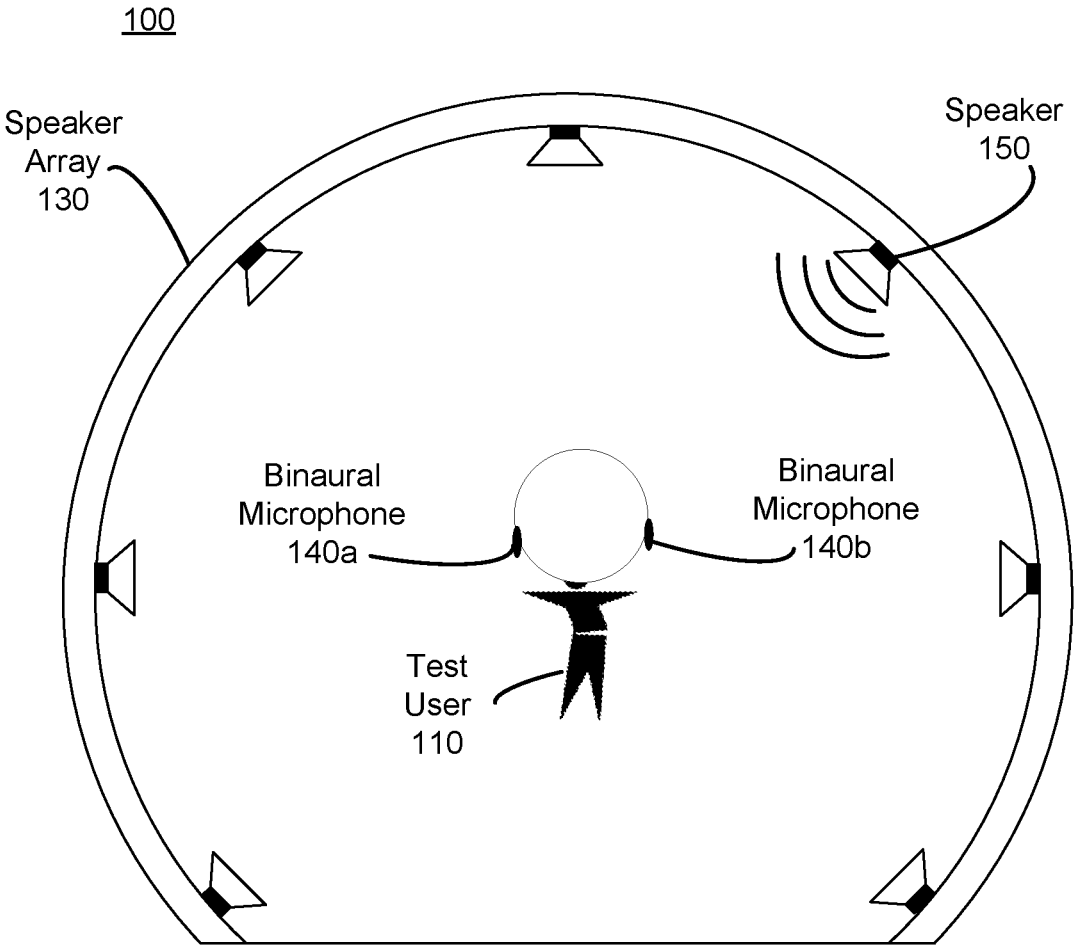
FIG. 1B is a diagram of the SMS of FIG. 1A configured to obtain audio data associated with the test user not wearing a headset, in accordance with one or more embodiments.

FIG. 1B is a diagram of the SMS 100 of FIG. 1A configured to obtain audio test data associated with the test user 110 not wearing a headset, in accordance with one or more embodiments. In the illustrated embodiments, the SMS 100 collects audio test data in the same way described above with respect to FIG. 1A, except that the test user 110 in FIG. 1B is not wearing a headset. Accordingly, the audio test data collected can be used to determine actual HRTF's of the test user 110 that do not include distortion introduced by wearing the headset 140.

Figure 2:
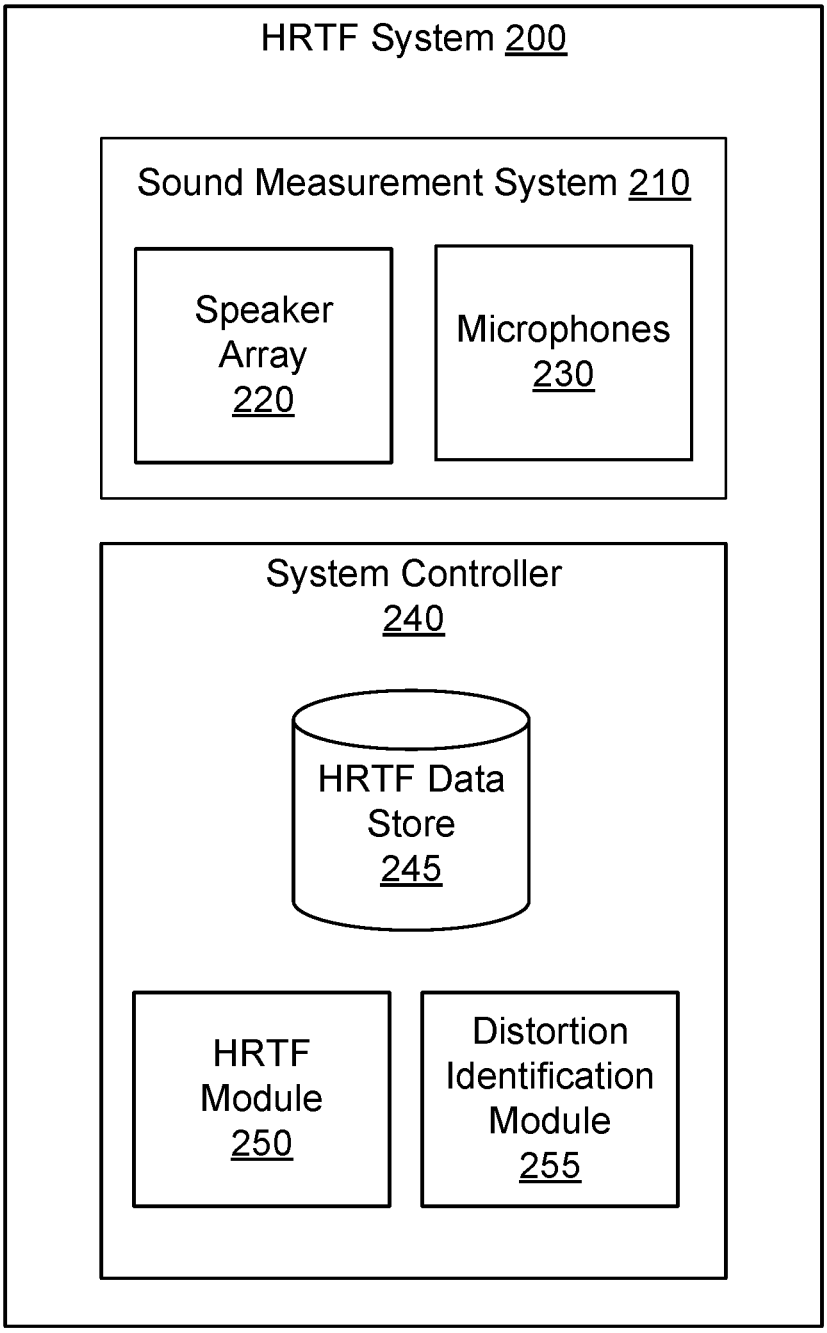
FIG. 2 is a block diagram a HRTF system, in accordance with one or more embodiments.

FIG. 2 is a block diagram a HRTF system 200, in accordance with one or more embodiments. The HRTF system 200 captures audio test data and determines portions of HRTFs commonly distorted by a headset. The HRTF system 200 includes a sound measurement system 210, and a system controller 240. In some embodiments some or all of the functions of the system controller 240 may be shared and/or performed by the SMS 210.

The SMS 210 captures audio test data to be used by the HRTF system 200 to determine a mapping of distortion regions. In particular, the SMS 210 is used to capture audio test data that is used to determine HRTFs of a test user. The SMS 210 includes a speaker array 220 and microphones 230. In some embodiments, the SMS 210 is the SMS 100 described in relation to FIGS. 1A and 1B. The captured audio data is stored in the HRTF data store 245.

The speaker array 220 emits test sounds in accordance with instructions from the system controller 240. The test sounds transmitted by the speaker array 130 may include, for example, a chirp (a signal whose frequency is swept upward or downward for a period of time), some other audio signal that may be used for HRTF determination, or some combination thereof. The speaker array 220 comprises one or more speakers that are positioned to project sound to a target area (i.e., location where a test user is located). In some embodiments, the speaker array 220 includes a plurality of speakers and each speaker of the plurality of speakers is in a different location relative to the test user in the target area. In some embodiments, one or more speakers of the plurality of speakers may dynamically change their position (e.g., in azimuth and/or elevation) relative to the target area. In some embodiments, one or more speakers of the plurality of speakers may change their position (e.g., in azimuth and/or elevation) relative to the test user by instructing the test user to rotate his/her head. The speaker array 130 is an embodiment of the speaker array 220.

The microphones 230 capture the test sounds emitted by the speaker array 220. The captured test sounds are referred to as audio test data. The microphones 230 include binaural microphones for each ear canal, and may include additional microphones. The additional microphones may be placed, e.g., in areas around the ears, along different portions of the headset, etc. The binaural microphones 140 are an embodiment of the microphones 230.

The system controller 240 generates control components of the HRTF system 200. The system controller 240 includes an HRTF data store 245, a HRTF module 250, and a distortion identification module 255. Some embodiments of the system controller 240 may include other components than those described herein. Similarly, the functions of components may be distributed differently than described here. For example, in some embodiments, some or all of the functionality of the HRTF module 250 may be part of the SMS 210.

The HRTF data store 245 stores data relating to the HRTF system 200. The HRTF data store 245 may store, e.g., audio test data associated with test users, HRTFs for test users wearing a headset, HRTFs for test users that are not wearing the headset, distortion mappings including sets of distortion regions for one or more test users, distortion mappings including sets of distortion regions for one or more populations of test users, parameters associated with physical characteristics of the test users, other data relating to the HRTF system 200, or some combination thereof. The parameters associated with physical characteristics of the test users may include gender, age, height, ear geometry, head geometry, and other physical characteristics that affect how audio is perceived by a user.

The HRTF module 250 generates instructions for the speaker array 220. The instructions are such that the speaker arrays 220 emits test sounds that can be captured at the microphones 230. In some embodiments, the instructions are such that each speaker of the speaker array 220 plays one or more a respective test sounds. And each test sound may have one or more of a specified length of time, a specified volume, a specified start time, a specified stop time, and a specified waveform (e.g., chirp, frequency tone, etc.). For example, the instructions may be such that one or more speakers of the speaker array 220 play, in sequence, a 1-second logarithmic sine sweep, ranging infrequency from 200 Hz to 20 kHz at a sampling frequency of 48 kHz, with a sounds level of 94 decibel of sounds pressure level (dB SPL). In some embodiments, each speaker of the speaker array 220 is associated with a different position relative to the target area, accordingly, each speaker is associated with a specific azimuth and elevation relative to the target area. In some embodiments, one or more speakers of the speaker array 220 may be associated with multiple positions. For example, the one or more speakers may change position relative to the target area. In these embodiments, the generated instructions may also control motion of some or all of speakers in the speaker array 220. In some embodiments, one or more speakers of the speaker array 220 may be associated with multiple positions. For example, the one or more speakers may change position relative to the test user by instructing the target user to rotate his/her head. In these embodiments, the generated instructions may also be presented to the test user. The HRTF module 250 provides the generated instructions to the speaker array 220 and/or the SMS 210.

The HRTF module 250 determines HRTFs for the test user using the audio test data captured via the microphones 230. In some embodiments, for each test sound played by a speaker of the speaker array 220 at a known elevation and azimuth, the microphones 230 capture audio test data of the test sound at the right ear and audio test data at the left ear (e.g., using binaural microphones as the microphones 230). The HRTF module 250 uses audio test data for the right ear and the audio test data for the left ear to determine a right-ear HRTF and a left-ear HRTF, respectfully. The right-ear and left-ear HRTFs are determined for a plurality of different directions (elevation and azimuth) that each correspond to a different location of a respective speaker in the speaker array 220.

Each set of HRTFs is calculated from captured audio test data for a particular test user. In some embodiments, the audio test data is a head-related impulse response (HRIR), where the test sound is the impulse. A HRIR relates the location of the sound source (i.e., a particular speaker in the speaker array 220) to the location of the test user's ear canal (i.e., the location of the microphones 230). The HRTFs are determined by taking the Fourier transform of each corresponding HRIR. In some embodiments, error in the HRTFs is mitigated using free-field impulse response data. The free-field impulse response data may be deconvolved from the HRIRs to remove the individual frequency response of the speaker array 220 and the microphones 230.

The HRTFs are determined at each direction both with the test user wearing a headset 120 (e.g., as shown in FIG. 1A) and the test user not wearing a headset (e.g., as shown in FIG. 1*i*). For example, the HRTFs are determined at each elevation and azimuth with the test user wearing the headset 120 (as shown in FIG. 1A), then the headset 120 is removed, and the HRTFs are measured at each elevation and azimuth with the user not wearing the headset 120 (as shown in FIG. 1). Audio test data at each speaker direction, both with and without the headset 120, may be captured for a population (e.g., hundreds, thousands, etc.) of test users. The population of test users may include individuals of differing ages, sizes, genders, hair lengths, head geometry, ear geometry, some other factor that can affect an HRTF, or some combination thereof. For each test user, there is a set of individualized HRTFs with the headset 120 and a set of individualized HRTFs without the headset 120.

The distortion identification module 255 compares one or more of the sets of HRTFs of a test user wearing a headset to one or more of the sets of HRTFs of the test user not wearing a headset. In one embodiment, the comparison involves the evaluation of the two sets of HRTFs using spectral difference error (SDE) analysis and determining discrepancies in the interaural time difference (ITD).

The SDE between the set of HRTFs without the headset and the set of HRTFs with the headset, for a particular test user, is calculated based on the formula:

$$SDE_{WO-Headset}(\Omega, f) = \left|20\log_{10}\frac{|HRTF_{WO}(\Omega, f)|}{|HRTF_{Headset}(\Omega, f)|}\right| \quad (1)$$

Where Ω is direction angle (azimuth and elevation), f is the frequency of the test sound, $HRTF_{WO}(\Omega, f)$ is the HRTF without the headset for the direction Ω and frequency f, and $HRTF_{Headset}(\Omega, f)$ is the HRTF with the headset for the direction Ω and frequency f. The SDE is calculated for each pair of HRTFs with and without the headset at a particular frequency and direction. The SDE is calculated for both ears at each frequency and direction.

In one embodiment, ITD error is also estimated by determining the time when the result of the correlation between the right and the left HRIRs reaches a maximum. For each measured test user, the ITD error may be calculated as the absolute value of the difference between the ITD of the HRTF without the headset and with the headset for each direction.

In some embodiments, a comparison of the set of HRTFs of a test user wearing a headset to the set of HRTFs of the test user not wearing a headset includes an additional subjective analysis. In one embodiment, each test user who had their HRTFs measured with and without the headset participates in a Multiple Stimuli with Hidden Reference and Anchor (MUSHRA) listening test to corroborate the results of the objective analysis. In particular, the MUSHRA test consists of a set of generalized HRTFs without the headset, a set of generalized HRTFs with the headset, the test user's individualized set of HRTFs without the headset, and the test user's individualized set of HRTFs with the headset, wherein the set of individualized HRTFs without the headset is the hidden reference and there is no anchor.

The distortion identification module 255 determines an average comparison across the population of test users. To determine an average comparison the $SDE_{WO-Headset}(\Omega, f)$ for each test user is averaged across the population of test users at each frequency and direction, denoted by $\overline{SDE}_{WO-Headset}(\Omega, f)$:

$$\overline{SDE}_{WO-Headset}(\Omega, f) = \frac{1}{N}\prod_{i}^{N}\left|20\log_{10}\frac{|HRTF_{WO_i}(\Omega, f)|}{|HRTF_{Headset_i}(\Omega, f)|}\right| \quad (2)$$

Where N is the total number of test users in the population of users. In alternate embodiments, $\overline{SDE}_{WO-Headset}(\Omega, f)$ may be determined by alternate calculations.

In one embodiment, the determination further includes averaging across the span of frequencies measured (e.g., 0-16 kHz), denoted by $\overline{SDE}_{WO-Headset}(\Omega)$. The SDE is found to generally be higher at higher frequencies. That is, the HRTF with the headset differs more dramatically from the HRTF without the headset at higher frequencies due to the fact that at high frequencies the wavelengths are large relative to the headset's form factor. Because of the general trend that the SDE is greater at higher frequencies, averaging across all frequencies allows for determination of particular azimuths and elevations at which the distortion due to the headset is more extreme.

The average ITD error across the population of test users, $\overline{ITD}_{WO-Headset}(\Omega)$, is calculated based on the following formula:

$$\overline{ITD}_{WO-Headset}(\Omega) = \frac{1}{N}\sum_{i}^{N}|ITD_{WO_i}(\Omega) - ITD_{Headset_i}(\Omega)| \quad (3)$$

Where N is the total number of test users in the population of test users, $ITD_{WO_i}(\Omega)$ is the maximum ITD of the HRTF without the headset at direction Ω of user i, and $ITD_{Headset_i}(\Omega)$ is the maximum ITD of the HRTF with the headset at direction Ω of user i.

The distortion identification module 255 determines a distortion mapping that identifies a set of one or more distortion regions based on portions of HRTFs commonly distorted across the population of test users. Using the $\overline{SDE}_{WO-Headset}(\Omega)$ and $\overline{ITD}_{WO-Headset}(\Omega)$, the directional dependence of the distortion of the HRTFs based on the presence of the headset can be determined. Both $\overline{SDE}_{WO-Headset}(\Omega)$ and $\overline{ITD}_{WO-Headset}(\Omega)$ can be plotted in two dimensions to determine particular azimuths and elevations where the errors are the greatest in magnitude. In one embodiment, the directions with the greatest error are determined by a particular threshold value of SDE and/or ITD. The determined directions of greatest error are the set of one or more distortion regions.

In one example, the threshold is high error in the contralateral direction greater than 4 dB of SDE. In this example, based on the $\overline{SDE}_{WO-Headset}(\Omega)$ for the left-HRTFs, regions of azimuth [−80°, −10° ] and elevation [−30°, 40° ] and regions of azimuth [−120°, −100° ] and elevation [−30°, 0° ] are above the SDE threshold. These regions are thereby determined to be the distortion regions.

In another example, the threshold is $\overline{ITD}_{WO-Headset}(\Omega)>50$ s. In this example, directions corresponding to the regions of azimuth [−115°, −100° ] and elevation [−15°, 0° ], azimuth [−60°, −30° ] and elevation [0°, 30° ], azimuth [30°, 60° ] and elevation [0°, 30° ], and azimuth [100°, −115° ] and elevation [−15°, 0° ] are above the ITD threshold. These regions are thereby determined to be the distortion regions.

The SDE and ITD analysis and thresholds may determine different distortion regions. In particular, the ITD analysis may result in smaller distortion region than the SDE analysis. In different embodiments, the SDE and ITD analyses may be used independently from one another, or used together.

Note that the distortion mapping is based on the HRTFs determined for a population of test users. In some embodiments, the population may be a single manakin. But in other embodiments, the population may include a plurality of test users having a large cross section of different physical characteristics. Note that in some embodiments, distortion maps are determined for populations having one or more common physical characteristics (e.g., age, gender, size, etc.). In this manner, the distortion identification module 255 may determine multiple distortion mappings that are each indexed to one or more specific physical characteristics. For example, one distortion mapping could be specific to adults that identifies a first set of distortion regions, and a separate distortion map could be specific to children that may identify a second set of distortion regions that are different than the first set of distortion regions.

The HRTF system 200 may communicate with one or more headsets and/or consoles. In some embodiments, the HRTF system 200 is configured to receive a query for distortion regions from a headset and/or console. In some embodiments, the query may include parameters about a user of the headset, which is used by the distortion identification module 255 to determine a set of distortion regions. For example, the query may include specific parameters about the user, such as height, weight, age, gender, dimensions of ears, and/or type of headset being worn. The distortion identification module 255 can use one or more of the parameters to determine a set of distortion regions. That is, the distortion identification module 255 uses parameters provided by the headset and/or console to determine a set of distortion regions from audio test data captured from test users with similar characteristics. The HRTF server 200 provides the determined set of distortion regions to the requesting headset and/or console. In some embodiments, the HRTF server 200 receives information (e.g., parameter about a user, sets of individualized HRTFs, HRTFs measured while a user is wearing a headset from a headset and/or console, or some combination thereof) from a headset (e.g., via a network). The HRTF server 200 may use the information to update one or more distortion mappings.

In some embodiments, the HRTF system 200 may be remote and/or separate from the sound measurement system 210. For example, the sound measurement system 210 may be communicatively coupled with the HRTF system 200 via a network (e.g., local area network, Internet, etc.). Similarly, the HRTF system 200 may connect to other components via a network, as discussed in greater detail below in reference to FIGS. 5 and 8.

Figure 3:
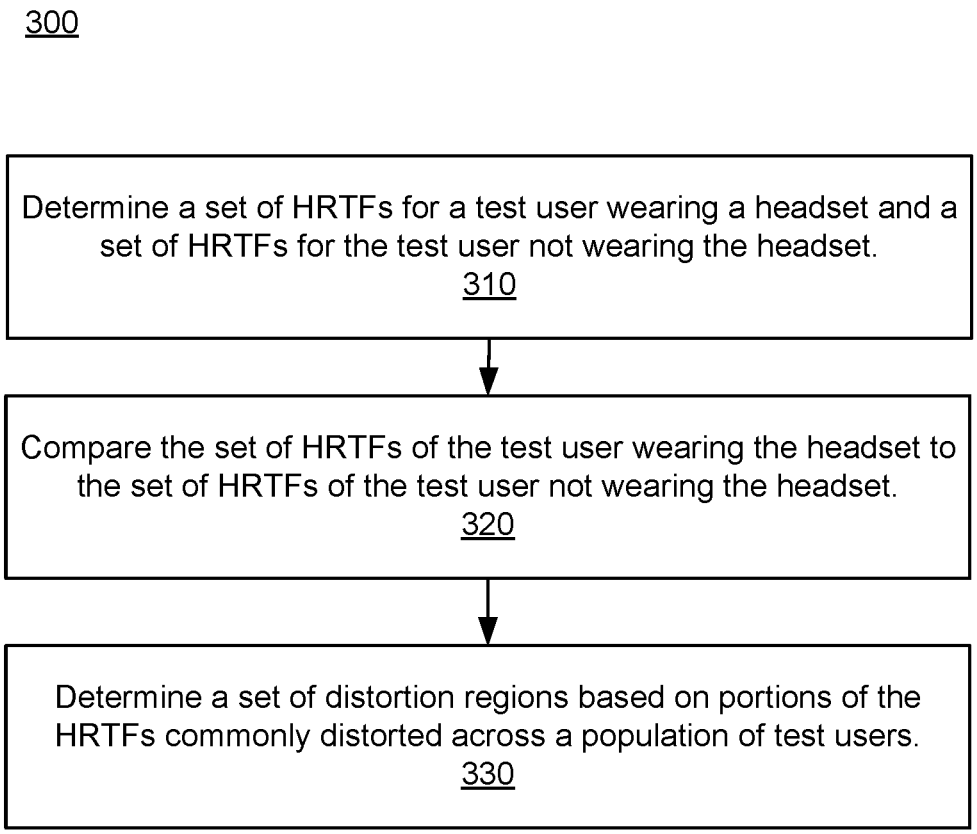
FIG. 3 is a flowchart illustrating a process for determining a set of distortion regions, in accordance with one or more embodiments.

FIG. 3 is a flowchart illustrating a process 300 of obtaining a set of distortion regions, in accordance with one or more embodiments. In one embodiment, the process 300 is performed by the HRTF system 200. Other entities may perform some or all of the steps of the process 300 in other embodiments (e.g., a server, headset, other connected device). Likewise, embodiment may include different and/or additional steps or perform the steps in a different order.

The HRTF system 200 determines 310 a set of HRTFs for a test user wearing a headset and a set of HRTFs for the test user not wearing the headset. Audio test data is captured by one or more microphones that are at or near the ear canals of a test user. The audio test data is captured for test sounds played from a variety of orientations, both with the test user wearing a headset and the user not wearing the headset. The audio test data is collected at each orientation both with and without the headset such that the audio test data can be compared for the instances with the headset and the instances without the headset. In one embodiment, this is done by the processes discussed above in relation to FIGS. 1A and 1B.

Note that audio test data can be captured over a population of test users that includes one or more test users from which audio test data was measured. In some embodiments, the population of test users can be one or more people. The one or more people can be further divided into subsets of the population based on different physical characteristics, such as gender, age, ear geometry, head dimensions, some other factor that may affect HRTFs for the test user, or some combination thereof. In other embodiments, a test user may be a manikin head. In some embodiments, a first manikin head may have average physical characteristics, whereas other manikins may have different physical characteristics and be similarly subdivided into subsets based on the physical characteristics.

The HRTF system 200 compares 320 the set of HRTFs for the test user wearing a headset and the set of HRTFs for the test user not wearing a headset. In one embodiment, the comparison 320 is performed using SDE analysis and/or ITD, as previously discussed in relation to the HRTF module 250 of FIG. 2 and equation (1). The comparison 320 may be repeated for a population of test users. The sets of HRTFs and corresponding audio test data can be grouped based on the physical characteristics of the population of test users.

The HRTF system 200 determines 330 a set of distortion regions based on portions of the HRTFs commonly distorted across a population of test users. In some embodiments, the population of test users is a subset of the previously discussed population of test users. In particular the distortion regions may be determined for a population of test users that is a subset of the total population of test users that meet one or more parameters based on physical characteristics. In one embodiment, the HRTF system 200 determines 330 using an average of the SDE and average of the ITD, as previously discussed in relation to the distortion identification module 255 of FIG. 2 and equations (2) and (3).

Example System for Calculating Individualized Sets of HRTFs

An audio system uses information from an HRTF system and HRTFs calculated while a user of a headset is wearing the headset to determine a set of individualized HRTFs that compensate for the effects of the headset. The audio system collects audio data for a user wearing a headset. The audio system may determine HRTFs for the user wearing the headset and/or provide the audio data to a separate system (e.g., HRTF system and/or console) for the HRTF determination. In some embodiments, the audio system requests a set of distortion regions based on the audio test data previously captured by the HRTF system, and uses the set of distortion regions to determine the individualized set of HRTFS for the user.

Figure 4A:
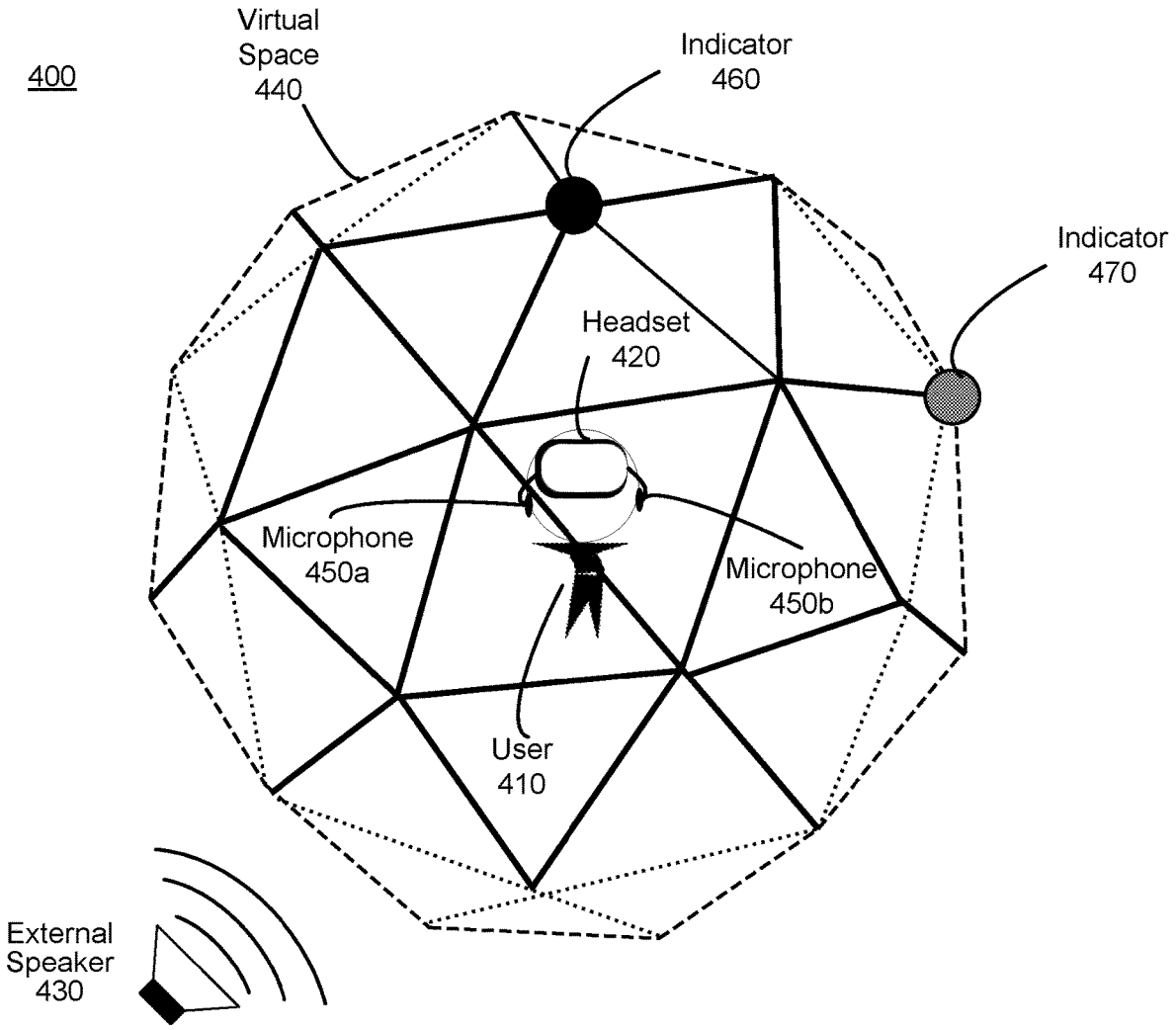
FIG. 4A is a diagram of an example artificial reality system for obtaining audio data associated with a user wearing a headset using an external speaker and a generated virtual space, in accordance with one or more embodiments.

FIG. 4A is a diagram of an example artificial reality system 400 for obtaining audio data associated with a user 410 wearing a headset 420 using an external speaker 430 and a generated virtual space 440, in accordance with one or more embodiments. The audio data obtained by the artificial reality system 400 is distorted by the presence of the headset 420, which is used by an audio system to calculate an individualized set of HRTFs for the user 410 that compensates for the distortion. The artificial reality system 400 uses artificial reality to enable measurement of individualized HRTFs for the user 410 without the use of anechoic chamber, such as the SMSs 100, 210 previously discussed in FIGS. 1A-3.

The user 410 is an individual, distinct from the test user 110 of FIGS. 1A and 1B. The user 410 is an end-user of the artificial reality system 400. The user 410 may use the artificial reality system 400 to create a set of individualized HRTFs that compensate for distortion of the HRTFs caused by the headset 420. The user 410 wears a headset 420 and a pair of microphones 450*a*, 450*b* (collectively referred to as "450"). The headset 420 can be the same type, model, or shape as the headset 120, as described in more detail in relation to FIGS. 7A and 7B. The microphones 450 can have the same properties as the binaural microphones 140, as discussed in relation to FIG. 1A, or the or microphones 230, as discussed in relation to FIG. 2. In particular, the microphones 450 are located at or near the entrance to the ear canals of the user 410.

The external speaker 430 is a device configured to transmit sound (e.g., test sounds) to the user 410. For example, the external speaker 430 may be a smartphone, a tablet, a laptop, a speaker of a desktop computer, a smart speaker, or any other electronic device capable of playing sound. In some embodiments, the external speaker 430 is driven by the headset 420 via a wireless connection. In other embodiments, the external speaker 430 is driven by a console. In one aspect, the external speaker 430 is fixed at one position and transmits test sounds that the microphones 450 can receive for calibrating HRTFs. For example, the external speaker 430 may play test sounds that are the same as those played by the speaker array 130, 220 of the SMS 100, 210. In another aspect, the external speaker 430 provides test sounds of frequencies that the user 410 can optimally hear based on audio characterization configuration, in accordance with the image presented on the headset 420.

The virtual space 440 is generated by the artificial reality system 400 to direct the orientation of the head of the user 410 while measuring the individualized HRTFs. The user 410 views the virtual space 440 through a display of the headset 420. The term "virtual space" 440 is not intended to be limiting. In some various embodiments the virtual reality space 440 may include virtual reality, augmented reality, mixed reality, or some other form of artificial reality.

In the embodiment illustrated, the virtual reality space 440 includes an indicator 460. The indicator 460 is presented on the display of the headset 420 to direct the orientation of the head of the user 410. The indicator 460 can be light, or a marking presented on the display of the headset 420. The position of the headset 420 can be tracked through an imaging device and/or an IMU (show in FIGS. 7A and 7B) to confirm whether the indicator 460 is aligned with the desired head orientation.

In one example, the user 410 is prompted to view the indicator 460. After confirming that the indicator 460 is aligned with the head orientation, for example based on the location of the indicator 460 displayed on the HMD 420 with respect to a crosshair, the external speaker 430 generates a test sound. For each ear a corresponding microphone 450*a*, 450*b* captures the received test sound as audio data.

After the microphones 450 successfully capture the audio data, the user 410 is prompted to direct their orientation towards a new indicator 470 at a different location in the virtual space 440. The process of capturing the audio data at indicator 460 is repeated to capture audio data at indicator 470. Indicators 460, 470 are generated at different locations in the virtual space 440 to capture audio data to be used to determine HRTFs at different head orientations of the user 410. Each indicator 460, 470 at a different location in the virtual space 440 enables the measurement of an HRTF at a different direction (elevation and azimuth). New indicators are generated and the process of capturing audio data is repeated to sufficiently span elevations and azimuths within the virtual space 440. The use of an external speaker 430 and a display of indicators 460, 470 within the virtual space 440 displayed via a headset 420 enables relatively convenient measurement the measurement of individualized HRTFs for a user 410. That is, the user 410 can perform these steps at their convenience in their own home with an artificial reality system 400, without the need for an anechoic chamber.

Figure 4B:
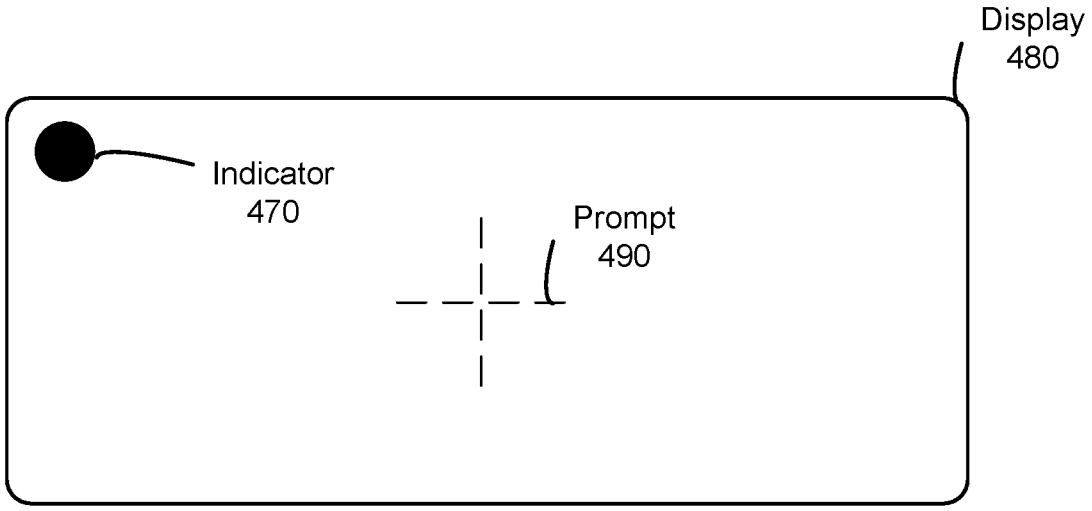
FIG. 4B is a diagram of a display in which an alignment prompt and an indicator are displayed by a headset and a user's head is not at a correct orientation, in accordance with one or more embodiments.

FIG. 4B is a diagram of a display 480 in which an alignment prompt 490 and an indicator 460 are displayed by a headset and a user's head is not at a correct orientation, in accordance with one or more embodiments. As shown in FIG. 4B, a display 480 presents an alignment prompt 490 on a center of the display 480 or at one or more predetermined pixels of the display 480. In this embodiment, the alignment prompt 490 is a crosshair. But more generally, the alignment prompt 490 is any text and/or graphical interface that shows the user whether the user's head is at the correct orientation relative to a displayed indicator 460. In one aspect, the alignment prompt 490 reflects a current head orientation and the indicator 460 reflects a target head orientation. The correct orientation occurs when the indicator 460 is at the center of the alignment prompt 490. In the example depicted in FIG. 4B, the indicator 460 is positioned on a top left corner of the display 480, rather than on the alignment prompt 490. Accordingly, the head orientation is not at the correct orientation. Moreover, because the indicator 460 and the alignment prompt 490 are not aligned it is apparent to the user that his/her head is not at the proper orientation.

Figure 4C:
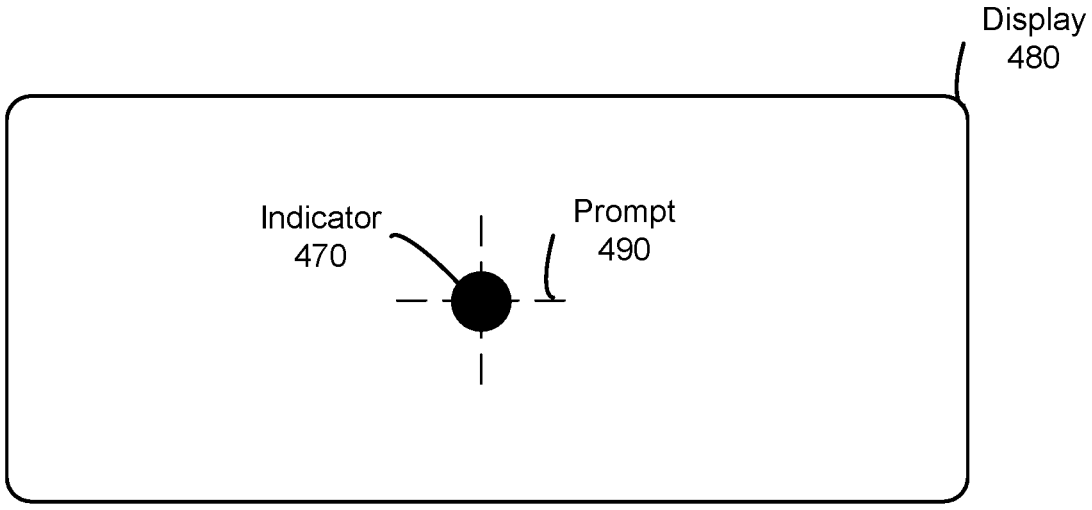
FIG. 4C is a diagram of the display of FIG. 4B in which the user's head is at a correct orientation, in accordance with one or more embodiments.

FIG. 4C is a diagram of the display of FIG. 4B in which the user's head is at a correct orientation, in accordance with one or more embodiments. The display 480 on FIG. 4C is substantially similar to the display 480 of FIG. 4B, except the indicator 460 is now displayed on the crosshair 490. Hence, it is determined the head orientation is properly aligned with the indicator 460 and the user's HRTF is measured for the head orientation. That is, a test sound is played by the external speaker 430 and captured as audio data at the microphones 450. Based on the audio data, an HRTF is determined for each ear at the current orientation. The process described in relation to FIGS. 4B and 4C is repeated for a plurality of different orientations of the head of the user 410 with respect to the external speaker 430. A set of HRTFs for the user 410 comprises an HRTF at each measured head orientation.

Figure 5:
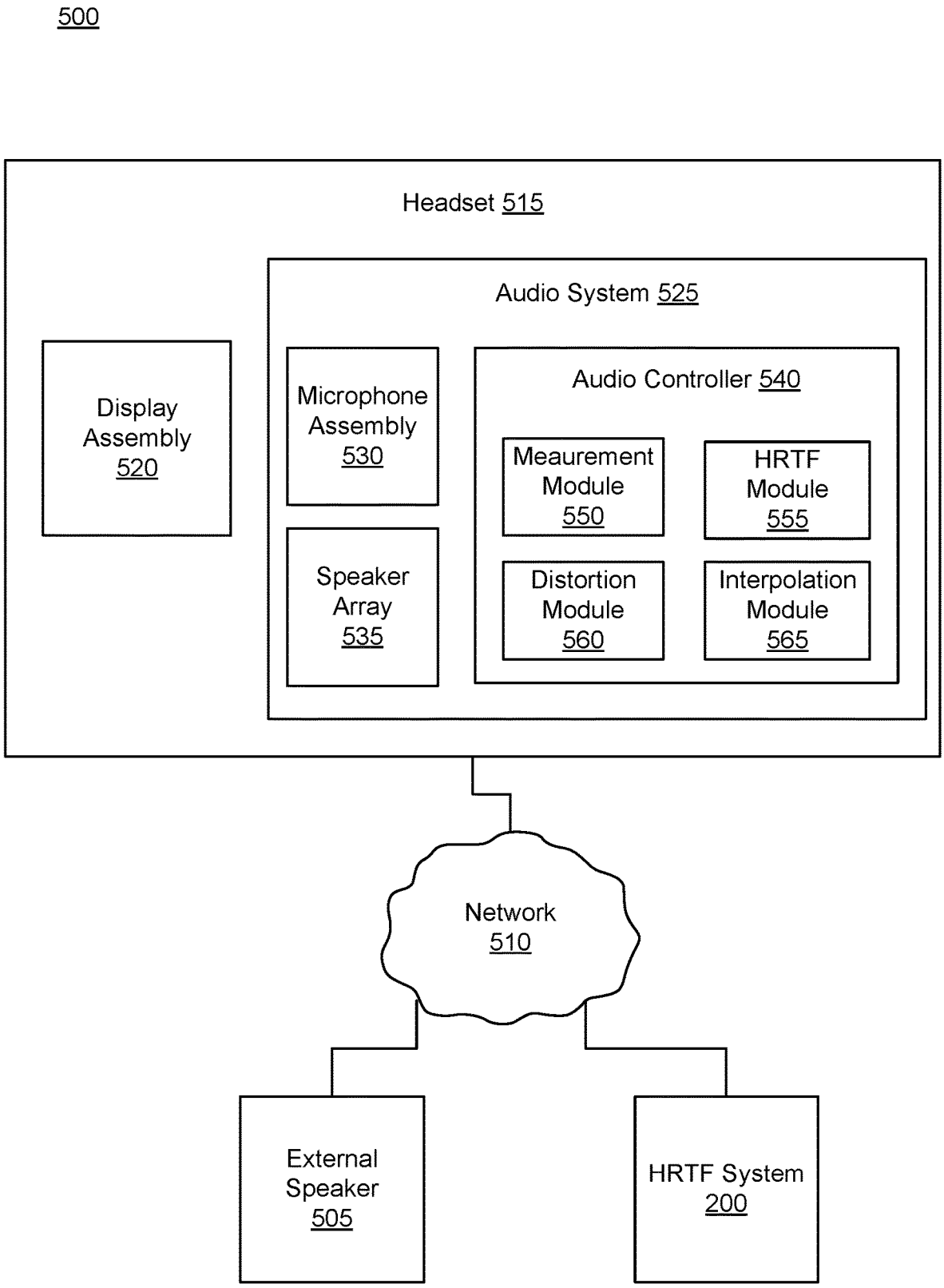
FIG. 5 is a block diagram of a system environment of a system for determining individualized HRTFs for a user, in accordance with one or more embodiments.

FIG. 5 is a block diagram of a system environment 500 of a system for determining individualized HRTFs for a user, in accordance with one or more embodiments. The system environment 500 comprises an external speaker 505, the HRTF system 200, a network 510, and a headset 515. The external speaker 505, the HRTF system 200, and the headset 515 are all connected via the network 510.

The external speaker 505 is a device configured to transmit sound to the user. In one embodiment, the external speaker 505 is operated according to commands from the headset 515. In other embodiments, the external speaker 505 is operated by an external console. The external speaker 505 is fixed at one position and transmits test sounds. Test sounds transmitted by the external speaker 505 include, for example, a continuous sinusoidal wave at a constant frequency, or a chirp. In some embodiments, the external speaker 505 is the external speaker 430 of FIG. 4A.

The network 510 couples the headset 515 and/or the external speaker 505 to the HRTF system 200. The network 510 may couple additional components to the HRTF system 200. The network 510 may include any combination of local area and/or wide area networks using both wireless and/or wired communication systems. For example, the network 510 may include the Internet, as well as mobile telephone networks. In one embodiment, the network 510 uses standard communications technologies and/or protocols. Hence, the network 510 may include links using technologies such as Ethernet, 802.11, worldwide interoperability for microwave access (WiMAX), 2G/3G/4G mobile communications protocols, digital subscriber line (DSL), asynchronous transfer mode (ATM), InfiniBand, PCI Express Advanced Switching, etc. Similarly, the networking protocols used on the network 510 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 510 can be represented using technologies and/or formats including image data in binary form (e.g. Portable Network Graphics (PNG)), hypertext markup language (HTML), extensible markup language (XML), etc. In addition, all or some of links can be encrypted using conventional encryption technologies such as secure sockets layer (SSL), transport layer security (TLS), virtual private networks (VPNs), Internet Protocol security (IPsec), etc.

The headset 515 presents media to a user. Examples of media presented by the headset 515 include one or more images, video, audio, or any combination thereof. The headset 515 comprises a display assembly 520, and an audio system 525. In some embodiments, the headset 515 is the headset 420 of FIG. 4A. Specific examples of embodiments of the headset 515 are described with regard to FIGS. 7A and 7B.

The display assembly 520 displays visual content to the user wearing the headset 515. In particular, the display assembly 520 displays 2D or 3D images or video to the user. The display assembly 520 displays the content using one or more display elements. A display element may be, e.g., an electronic display. In various embodiments, the display assembly 520 comprises a single display element or multiple display elements (e.g., a display for each eye of a user). Examples of display elements include: a liquid crystal display (LCD), a light emitting diode (LED), display, a micro-light-emitting diode (μLED) display, an organic light-emitting diode (OLED) display, an active-matrix organic light-emitting diode display (AMOLED), a waveguide display, some other display, or some combination thereof. In some embodiments, the display assembly 520 is at least partially transparent. In some embodiments, the display assembly 520 is the display 480 of FIGS. 4B and 4C.

The audio system 525 determines a set of individualized HRTFs for the user wearing the headset 515. In one embodiment, the audio system 525 comprises hardware, including one or more microphones 530 and a speaker array 535, as well as an audio controller 540. Some embodiments of the audio system 525 have different components than those described in conjunction with FIG. 5. Similarly, the functions further described below may be distributed among components of the audio system 525 in a different manner than is described here. In some embodiments, some of the functions described below may be performed by other entities (e.g., the HRTF system 200).

The microphone assembly 530 captures audio data of the test sounds emitted by the external speaker 505. In some embodiment, the microphone assembly 530 is one or more microphones 530 located at or near the ear canal of the user. In other embodiments, the microphone assembly 530 is external from the headset 515 and is controlled by the headset 515 via the network 510. The microphone assembly 530 may be the pair of microphones 450 of FIG. 4A.

The speaker array 535 play audio for the user in accordance with instructions from the audio controller 540. The audio played for the user by the speaker array 535 may include instructions to facilitating the capture of the test sound audio by the one or more microphones 530. The speaker array 535 is distinct from the external speaker 505.

The audio controller 540 controls components of the audio system 525. In some embodiments, the audio controller 540 may also control the external speaker 505. The audio controller 540 includes a plurality of modules including a measurement module 550, a HRTF module 555, a distortion module 560, and an interpolation module 565. Note that in alternate embodiments, some or all of the modules of the audio controller 540 may be performed (wholly or in-part) by other entities (e.g., the HRTF system 200). The audio controller 540 is coupled to other components of the audio system 525. In some embodiments, the audio controller 540 is also coupled to the external speaker 505 or other components of the system environment 500 via communication coupling (e.g., wired or wireless communication coupling). The audio controller 540 may perform initial processing of data obtained from the microphone assembly 530 or other received data. The audio controller 540 communicates received data to other components in the headset 515 and the system environment 500

The measurement module 550 configures the capture of audio data of test sounds played by the external speaker 505. The measurement module 550 provides instructions to the user to orient their head in a particular direction via the headset 525. The measurement module 505 sends signals via the network 510 to the external speaker 505 to play one or more test sounds. The measurement module 550 instructs the one or more microphones 530 to capture audio data of the test sounds. The measurement module 550 repeats this process for a predetermined span of head orientations. In some embodiments, the measurement module 550 uses the process described in relation to FIGS. 4A-4C.

In one embodiment, the measurement module 550 sends instructions to the user to orient their head in a particular direction using the speaker array 535. The speaker array 535 may play audio with verbal instructions or other audio to indicate a particular head orientation. In other embodiments, the measurement module 550 uses the display assembly 520 to provide the user with visual cues to orient his/her head. The measurement module 550 may generate a virtual space with an indicator, such as the virtual space 440 and the indicator 460 of FIG. 4A. The visual cue provided via the display assembly 520 to the user may be similar to the prompt 490 on the display 480 of FIG. 480.

When the measurement module 550 has confirmed the user has the desired head orientation, the measurement module 550 instructs the external speaker 505 to play a test sound. The measurement module 550 specifies the characteristics of the test sound, such as frequency, length, type (e.g., sinusoidal, chirp, etc.). To capture the test sound, the measurement module 550 instructs the one or more microphones 530 to record audio data. Each microphone captures audio data, (e.g., HRIR) of the test sound at its respective location.

The measurement module 550 iterates through the above described steps for a predetermined set of head orientations that span a plurality of azimuths and elevations. In one embodiment, the predetermined set of orientations spans the 612 directions described in relation to FIG. 1A. In another embodiment, the predetermined set of orientations spans a subset of the set of directions measured by the sound measurement system 100. The process performed by the measurement module 550 enables convenient and relatively easy measurement of audio data for the determination of an individualized set of HRTFs.

The HRTF module 555 calculates an initial set of HRTFs for the audio data captured by the measurement module 550 for the user wearing the headset 515. The initial set of HRTFs determined by the HRTF module 555 includes one or more HRTFs that are distorted by the presence of the headset 515. That is, the HRTFs of one or more particular directions (e.g., ranges of elevations and azimuths) are distorted by the presence of the headset, such that sound played with the HRTFs gives an impression that the user is wearing the headset (versus giving the impression to the user that they are not wearing the headset—e.g., as part of a VR experience). In an embodiment where the measurement module 550 captures audio data in the form of HRIRs, the HRTF module 555 determines the initial set of HRTFs by taking the Fourier transform of each corresponding HRIR. In some embodiments, each HRTF in the initial set of HRTFs is directionally-dependent, $H(\Omega)$, where $\Omega$ is direction. The direction further comprises an elevation angle, $\theta$, and an azimuth angle, $\phi$, represented as $\Omega=(\theta,\phi)$. That is, an HRTF is calculated corresponding to each measured direction (elevation and azimuth). In other embodiments, each HRTF is frequency- and directionally-dependent, $H(\Omega,f)$, where f is a frequency.

In some embodiments, the HRTF module 555 utilizes data of sets of individualized HRTFs or a generalized set of HRTFs to calculate the initial set of HRTFs. The data may be preloaded on the headset 515 in some embodiments. In other embodiments, the data may be accessed by the headset 515 via the network 510 from the HRTF system 200. In some embodiments, the HRTF module 555 may use processes and computations substantially similar to the SMS 210 of FIG. 2.

The distortion module 560 modifies the initial set of HRTFs calculated by the HRTF module 555 to remove portions distorted by the presence of the headset 515, creating an intermediate set of HRTFs. The distortion module 560 generates a query for a distortion mapping. As discussed above with regard to FIG. 2, the distortion mapping includes a set of one or more distortion regions. The query may include one or more parameters corresponding to physical features of the user, such as gender, age, height, ear geometry, head geometry, etc. In some embodiments, the distortion module 560 sends the query to a local storage of the headset. In other embodiments, the query is sent to the HRTF system 200 via the network. The distortion module 560 receives some or all of a distortion mapping that identifies a set of one or more distortion regions. In some embodiments, the distortion mapping may be specific to a population of test users having one or more physical characteristic in common with some or all of the parameters in the query. The set of one or more distortion regions include directions (e.g., azimuth and elevation relative to the headset) of HRTFs that are commonly distorted by the headset.

In some embodiments, the distortion module 560 discards portions of the initial set of HRTFs corresponding to the set of one or more distortion regions, resulting in an intermediate set of HRTFs. In some embodiments, the distortion module 560 discards the portions of the directionally-dependent HRTFs corresponding to the particular directions (i.e., azimuths and elevations) of the set of one or more distortion regions. In other embodiments, the distortion module 560 discards the portions of the frequency- and directionally-dependent HRTFs corresponding to the particular directions and frequencies of the set of distortion regions.

For example, the set of one or more distortion regions comprise the region of azimuth [−80°, −10° ] and elevation [−30°, 40° ] and region of azimuth [−120°, −100° ] and elevation [−30°, 0° ]. The HRTFs in the initial set of HRTFs corresponding to directions comprised in these regions are removed from the set of HRTFs, creating an intermediate set of HRTFs. For example, the HRTF $H(\Omega=(0°, -50°))$ falls within one of the distortion regions and is removed from the set of HRTFs by the distortion module 560. The HRTF $H(\Omega=(0°, 50°))$ falls outside the directions comprised in the set of distortion regions and is included in the intermediate set of HRTFs. A similar process is followed when the distortion regions further comprise particular frequencies.

The interpolation module 565 may use the intermediate set of HRTFs to generate an individualized set of HRTFs that compensates for the presence of the headset 515. The interpolation module 565 interpolates some or all of the intermediate set to generate a set of interpolated HRTFs. For example, the interpolation module 565 may select HRTFs that are within some angular range from the discarded portions, and use interpolation and the selected HRTFs to generate a set of interpolated HRTFs. The set of interpolated HRTFs combined with the intermediate set of HRTFs produce a complete set of individualized HRTFs that mitigate headset distortion.

In some embodiments, the generated individualized set of HRTFs that compensate for the distortion caused by a headset is stored. In some embodiments, the generated individualized set of HRTFs is maintained on the local storage of the headset and can be used in the future by the user. In other embodiments, the generated individualized set of HRTFs is uploaded to the HRTF system 200.

Producing a set of individualized HRTFs that compensate for distortion caused by a headset improves a virtual reality experience of a user. For example, a user is wearing the headset 515 and experiencing a video-based virtual reality environment. The video-based virtual reality environment is intended to make the user forget that the reality is virtual, both in terms of video and audio quality. The headset 515 does this by removing ques (visual and auditory) to the user that they are wearing the headset 515. The headset 515 provides an easy and convenient way to measure HRTFs of the user. However, HRTFs measured with the headset 515 being worn by the user have inherent distortion caused by the presence of the headset 515. Playing audio using the distorted HRTFs would maintain an auditory que to the user that the headset is being worn—and would not align with a VR experience that makes it as-if no headset is worn by the user. And as exampled above the audio system 525 generates an individualized set of HRTFs using the measured HRTFs and a distortion mapping. The audio system 525 can then present audio content to the user using the individualized HRTFs in a manner such that the audio experience is as-if the user is not wearing a headset and, thereby, would align with a VR experience that makes it as-if no headset is worn by the user.

Figure 6:
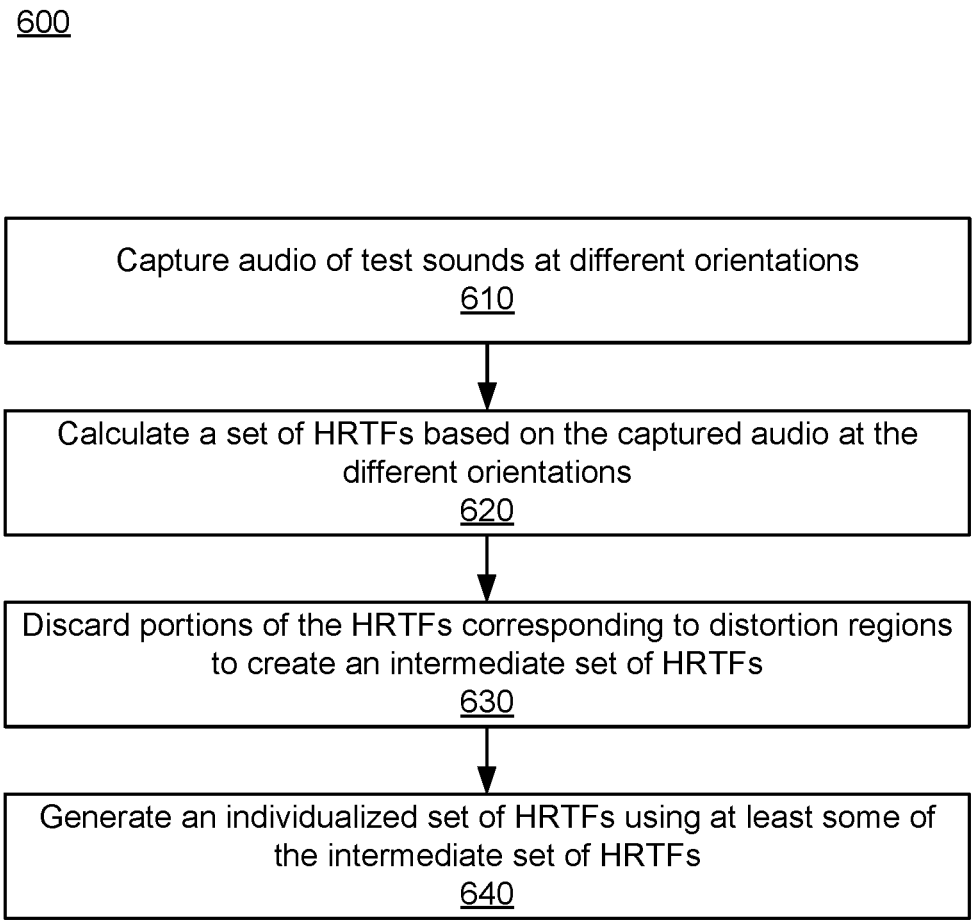
FIG. 6 is a flowchart illustrating a process of obtaining a set of individualized HRTFs for a user, in accordance with one or more embodiments

FIG. 6 is a flowchart illustrating a process 600 of obtaining a set of individualized HRTFs for a user, in accordance with one or more embodiments. In one embodiment, the process 600 is performed by the headset 515. Other entities may perform some or all of the steps of the process 600 in other embodiments (e.g., the external speaker 505, or the HTRF server 200). Likewise, embodiments may include different and/or additional steps, or perform the steps in different orders.

The headset 515 captures 610 audio data of test sounds at different orientations. The headset 515 prompts the user to orient his/her head in a particular direction while wearing the headset 515. The headset 515 instructs a speaker (e.g., the external speaker 505) to play a test sound and audio data of the test sound is captured 610 by one or more microphones (e.g., microphones 530) at or near the user's ear canal. The capturing 610 is repeated for a plurality of different head orientations of the user. FIG. 4A-4C illustrate one embodiment of the capture 610 of audio data. The measurement module 550 of FIG. 5 performs the capturing 610, according to some embodiments.

The headset 515 determines 620 a set of HRTFs based on the audio data at the different orientations. In some embodiments, an HRTF module (e.g., the HRTF module 555) calculates the set of HRTFs using the audio data. The headset 515 may use conventional methods for calculating an HRTF using audio data originating from a specific location relative to the headset. In other embodiments, the headset may provide the audio data to an external device (e.g., a console and/or a HRTF system) to calculate the set of HRTFs.

The headset 515 discards 630 portions of the HRTFs corresponding to a set of distortion regions to create an intermediate set of HRTFs. The headset 515 generates a query for a set of distortion regions. In some embodiments, the headset 515 sends the query to a local storage of the headset 515 (e.g., the distortion regions are pre-loaded). In other embodiments, the headset 515 sends the query to the HRTF system 200 via the network 510, in which case the distortion regions are determined by an external system (e.g. the HRTF system 200). The set of distortion regions may be determined based on HRTFs of a population of test users or based on a manikin. Responsive to the query, the headset 515 receives a set of distortion regions and discards the portions of the set of HRTFs corresponding to one or more directions comprised within the set of distortion regions. According to some embodiments, the distortion module 560 of FIG. 5 performs the discarding 630.

The headset 515 generates 640 an individualized set of HRTFs using at least some of the intermediate set of HRTFs. The missing portions are interpolated based on the intermediate set of HRTFs and, in some embodiments, a distortion mapping of HRTFs associated with the distortion regions. In some embodiments, the interpolation module 565 of FIG. 5 performs the generating 640. In other embodiments, the headset 515 and generates 640 the individualized set of HRTFs.

In some embodiments, the HRTF system 200 performs at least some of the steps of the process. That is, the HRTF system 200 provides instructions to the headset 515 and external speakers 505 to capture 610 audio data of test sounds at different orientations. The HRTF system 200 sends a query to the headset 515 for audio data and receives the audio data. The HRTF system 200 calculates 620 a set of HRTFs based on the audio data at the different orientations and discards 630 portions of the HRTFs corresponding to distortion regions to create an intermediate set of HRTFs. The HRTF system 200 generates 640 an individualized set of HRTFs using at least some of the intermediate set of HRTFs and provides the individualized set of HRTFs to the headset 515 for use.

Figure 7A:
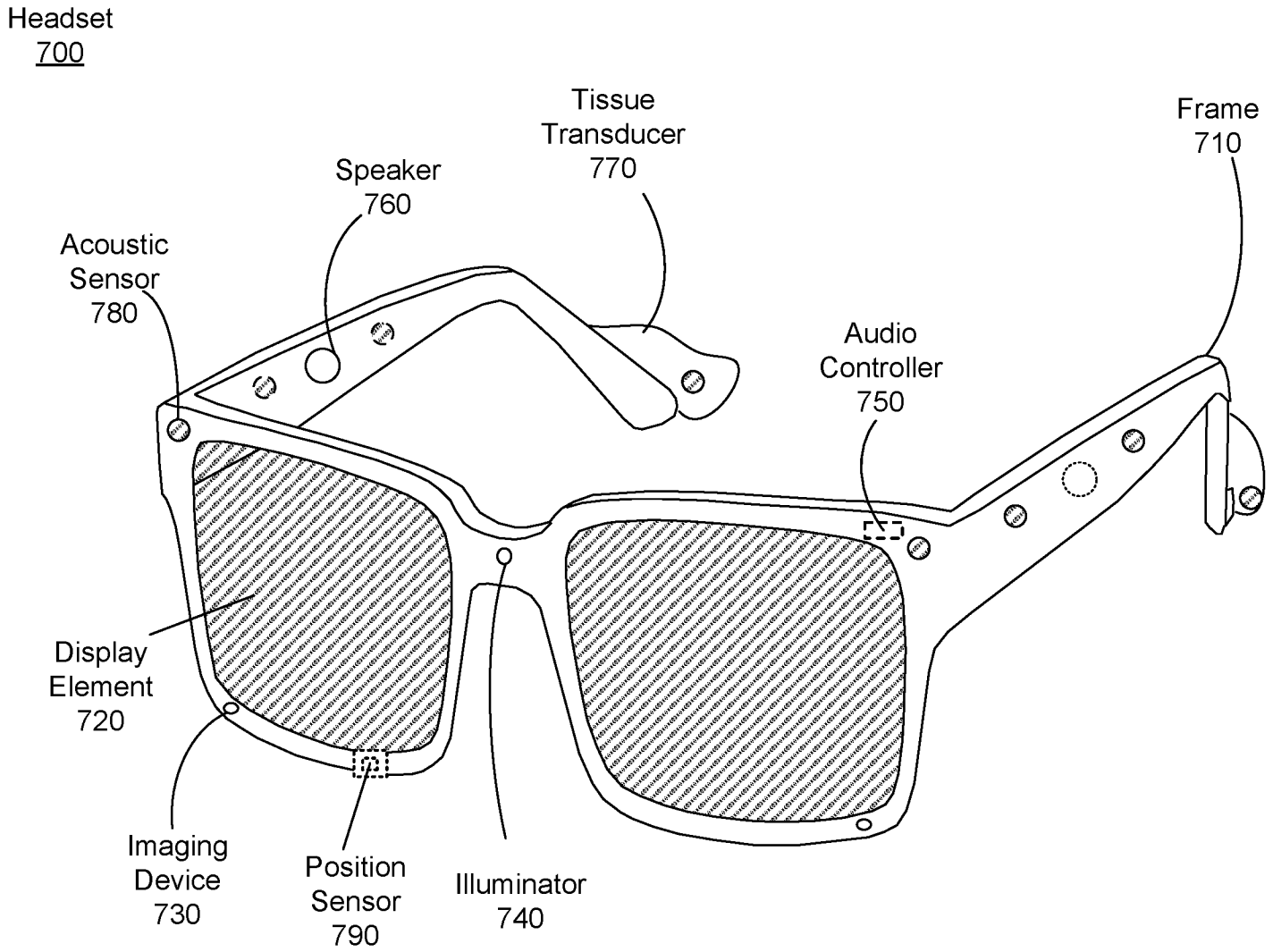
FIG. 7A is a perspective view of a headset implemented as an eyewear device, in accordance with one or more embodiments.

FIG. 7A is a perspective view of a headset 700 implemented as an eyewear device, in accordance with one or more embodiments. In some embodiments, the eyewear device is a near eye display (NED). In general, the headset 700 may be worn on the face of a user such that content (e.g., media content) is presented using a display assembly, such as the display assembly 520 of FIG. 5, and/or an audio system, such as the audio system 525 of FIG. 5. However, the headset 700 may also be used such that media content is presented to a user in a different manner. Examples of media content presented by the headset 700 include one or more images, video, audio, or some combination thereof. The headset 700 includes a frame, and may include, among other components, a display assembly including one or more display elements 720, a depth camera assembly (DCA), an audio system, and a position sensor 790. While FIG. 7A illustrates the components of the headset 700 in example locations on the headset 700, the components may be located elsewhere on the headset 700, on a peripheral device paired with the headset 700, or some combination thereof. Similarly, there may be more or fewer components on the headset 700 than what is shown in FIG. 7A.

The frame 710 holds the other components of the headset 700. The frame 710 includes a front part that holds the one or more display elements 720 and end pieces (e.g., temples) to attach to a head of the user. The front part of the frame 710 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 720 provide light to a user wearing the headset 700. The one or more display elements may be part of the display assembly 520 of FIG. 5. As illustrated the headset includes a display element 720 for each eye of a user. In some embodiments, a display element 720 generates image light that is provided to an eyebox of the headset 700. The eyebox is a location in space that an eye of user occupies while wearing the headset 700. For example, a display element 720 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 700. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 720 are opaque and do not transmit light from a local area around the headset 700. The local area is the area surrounding the headset 700. For example, the local area may be a room that a user wearing the headset 700 is inside, or the user wearing the headset 700 may be outside and the local area is an outside area. In this context, the headset 700 generates VR content. Alternatively, in some embodiments, one or both of the display elements 720 are at least partially transparent, such that light from the local area may be combined with light from the one or more display elements to produce AR and/or MR content.

In some embodiments, a display element 720 does not generate image light, and instead is a lens that transmits light from the local area to the eyebox. For example, one or both of the display elements 720 may be a lens without correction (non-prescription) or a prescription lens (e.g., single vision, bifocal and trifocal, or progressive) to help correct for defects in a user's eyesight. In some embodiments, the display element 720 may be polarized and/or tinted to protect the user's eyes from the sun.

Note that in some embodiments, the display element 720 may include an additional optics block (not shown). The optics block may include one or more optical elements (e.g., lens, Fresnel lens, etc.) that direct light from the display element 720 to the eyebox. The optics block may, e.g., correct for aberrations in some or all of the image content, magnify some or all of the image, or some combination thereof.

The DCA determines depth information for a portion of a local area surrounding the headset 700. The DCA includes one or more imaging devices 730 and a DCA controller (not shown in FIG. 7A), and may also include an illuminator 740. In some embodiments, the illuminator 740 illuminates a portion of the local area with light. The light may be, e.g., structured light (e.g., dot pattern, bars, etc.) in the infrared (IR), IR flash for time-of-flight, etc. In some embodiments, the one or more imaging devices 730 capture images of the portion of the local area that include the light from the illuminator 740. As illustrated, FIG. 7A shows a single illuminator 740 and two imaging devices 730. In alternate embodiments, there is no illuminator 740 and at least two imaging devices 730.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 740), some other technique to determine depth of a scene, or some combination thereof.

The audio system provides audio content. The audio system may be an embodiment of the audio system 525 of FIG. 5. In one embodiment, the audio system includes a transducer array, a sensor array, and an audio controller 750. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server, such as the HRTF system 200.

The transducer array presents sound to user. The transducer array includes a plurality of transducers. A transducer may be a speaker 760 or a tissue transducer 770 (e.g., a bone conduction transducer or a cartilage conduction transducer). Although the speakers 760 are shown exterior to the frame 710, the speakers 760 may be enclosed in the frame 710. In some embodiments, instead of individual speakers for each ear, the headset 700 includes a speaker array, such as the speaker array 535 of FIG. 5, comprising multiple speakers integrated into the frame 710 to improve directionality of presented audio content. The tissue transducer 770 couples to the head of the user and directly vibrates tissue (e.g., bone or cartilage) of the user to generate sound. The number and/or locations of transducers may be different from what is shown in FIG. 7A.

The sensor array detects sounds within the local area of the headset 700. The sensor array includes a plurality of acoustic sensors 780. An acoustic sensor 780 captures sounds emitted from one or more sound sources in the local area (e.g., a room). Each acoustic sensor is configured to detect sound and convert the detected sound into an electronic format (analog or digital). The acoustic sensors 780 may be acoustic wave sensors, microphones, sound transducers, or similar sensors that are suitable for detecting sounds.

In some embodiments, one or more acoustic sensors 780 may be placed in an ear canal of each ear (e.g., acting as binaural microphones, or the microphone assembly 530 of FIG. 5). In some embodiments, the acoustic sensors 780 may be placed on an exterior surface of the headset 700, placed on an interior surface of the headset 700, separate from the headset 700 (e.g., part of some other device), or some combination thereof. The number and/or locations of acoustic sensors 780 may be different from what is shown in FIG. 7A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 700.

The audio controller 750 processes information from the sensor array that describes sounds detected by the sensor array. The audio controller 750 may comprise a processor and a computer-readable storage medium. The audio controller 750 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 760, or some combination thereof. The audio controller 750 is an embodiment of the audio controller 540 of FIG. 5.

The position sensor 790 generates one or more measurement signals in response to motion of the headset 700. The position sensor 790 may be located on a portion of the frame 710 of the headset 700. The position sensor 790 may include an inertial measurement unit (IMU). Examples of position sensor 790 include: one or more accelerometers, one or more gyroscopes, one or more magnetometers, another suitable type of sensor that detects motion, a type of sensor used for error correction of the IMU, or some combination thereof. The position sensor 790 may be located external to the IMU, internal to the IMU, or some combination thereof.

In some embodiments, the headset 700 may provide for simultaneous localization and mapping (SLAM) for a position of the headset 700 and updating of a model of the local area. For example, the headset 700 may include a passive camera assembly (PCA) that generates color image data. The PCA may include one or more RGB cameras that capture images of some or all of the local area. In some embodiments, some or all of the imaging devices 730 of the DCA may also function as the PCA. The images captured by the PCA and the depth information determined by the DCA may be used to determine parameters of the local area, generate a model of the local area, update a model of the local area, or some combination thereof. Furthermore, the position sensor 790 tracks the position (e.g., location and pose) of the headset 700 within the room. Additional details regarding the components of the headset 700 are discussed below in connection with FIG. 8.

Figure 7B:
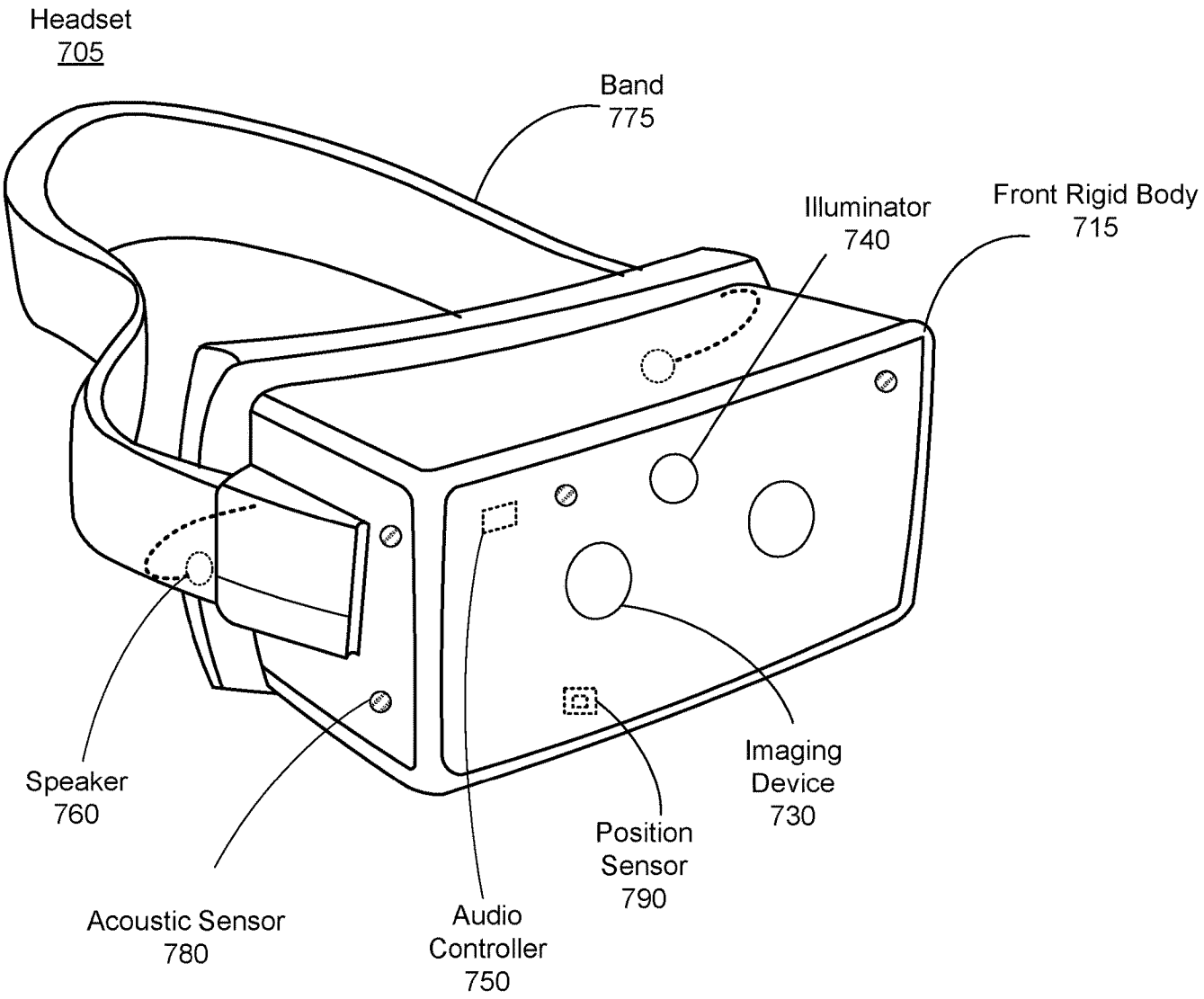
FIG. 7B is a perspective view of a headset implemented as a HMD, in accordance with one or more embodiments.

FIG. 7B is a perspective view of a headset 705 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 715 and a band 775. The headset 705 includes many of the same components described above with reference to FIG. 7A, but modified to integrate with the HMD form factor. For example, the HMD includes a display assembly, a DCA, an audio system (e.g., an embodiment of the audio system 525), and a position sensor 790. FIG. 7B shows the illuminator 740, a plurality of the speakers 760, a plurality of the imaging devices 730, a plurality of acoustic sensors 780, and the position sensor 790.

Figure 8:
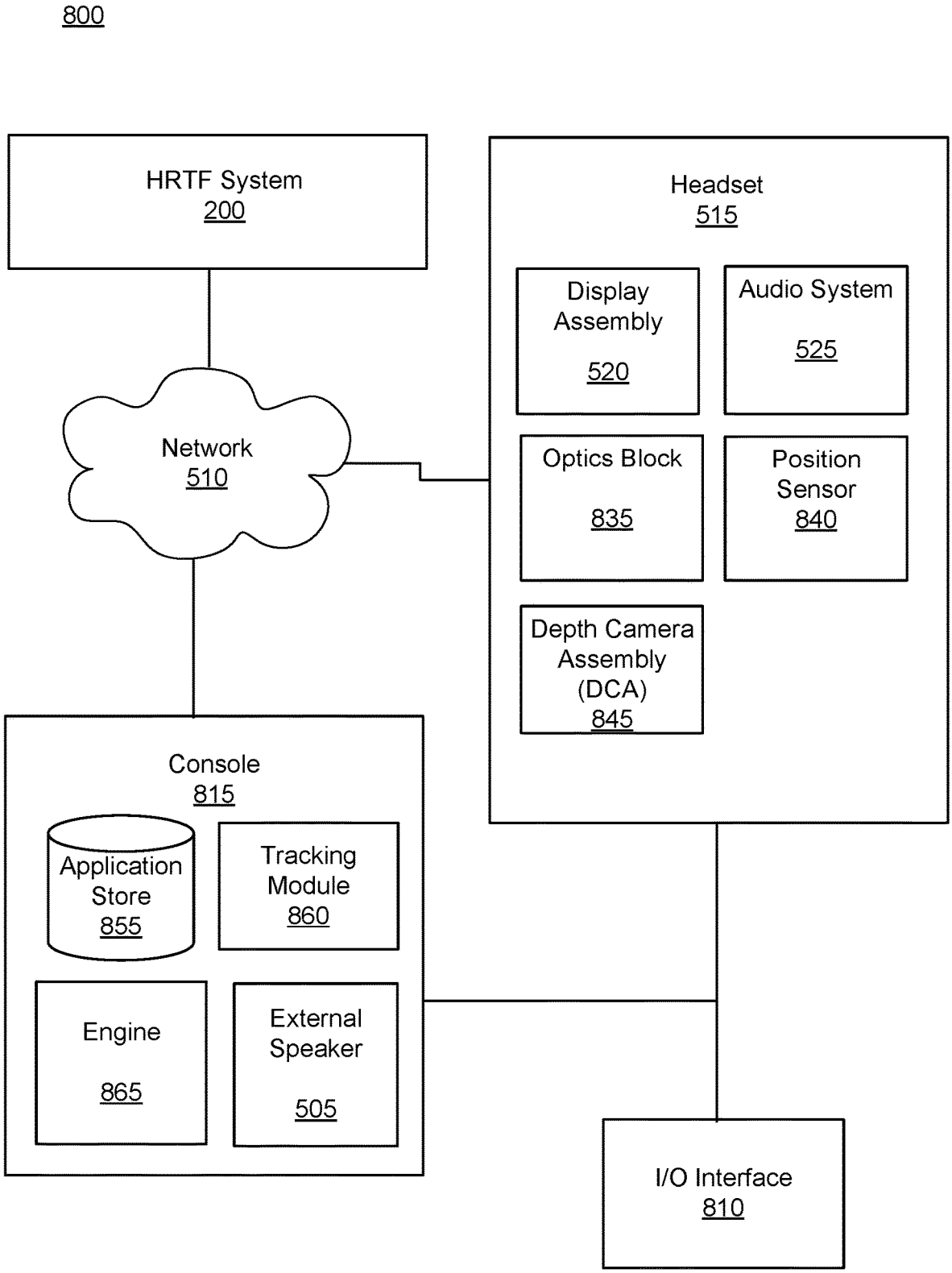
FIG. 8 is a block diagram of a system environment that includes a headset and a console, in accordance with one or more embodiments.

FIG. 8 is a is a system 800 that includes a headset 515, in accordance with one or more embodiments. In some embodiments, the headset 515 may be the headset 700 of FIG. 7A or the headset 705 of FIG. 7B. The system 800 may operate in an artificial reality environment (e.g., a virtual reality environment, an augmented reality environment, a mixed reality environment, or some combination thereof). The system 800 shown by FIG. 8 includes the headset 515, an input/output (I/O) interface 810 that is coupled to a console 815, the network 510, and the HRTF system 200. While FIG. 8 shows an example system 800 including one headset 515 and one I/O interface 810, in other embodiments any number of these components may be included in the system 800. For example, there may be multiple headsets each having an associated IO interface 810, with each headset and I/O interface 810 communicating with the console 815. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 815 may be provided by the headset 515.

The headset 515 includes the display assembly 520, the audio system 525, an optics block 835, one or more position sensors 840, and a Depth Camera Assembly (DCA) 845. Some embodiments of headset 515 have different components than those described in conjunction with FIG. 8. Additionally, the functionality provided by various components described in conjunction with FIG. 8 may be differently distributed among the components of the headset 515 in other embodiments, or be captured in separate assemblies remote from the headset 515.

In one embodiment, the display assembly 520 displays content to the user in accordance with data received from the console 815. The display assembly 520 displays the content using one or more display elements (e.g., the display elements 720). A display element may be, e.g., an electronic display. In various embodiments, the display assembly 520 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 720 may also include some or all of the functionality of the optics block 835.

The optics block 835 may magnify image light received from the electronic display, corrects optical errors associated with the image light, and presents the corrected image light to one or both eyeboxes of the headset 515. In various embodiments, the optics block 835 includes one or more optical elements. Example optical elements included in the optics block 835 include: an aperture, a Fresnel lens, a convex lens, a concave lens, a filter, a reflecting surface, or any other suitable optical element that affects image light. Moreover, the optics block 835 may include combinations of different optical elements. In some embodiments, one or more of the optical elements in the optics block 835 may have one or more coatings, such as partially reflective or anti-reflective coatings.

Magnification and focusing of the image light by the optics block 835 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 835 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 835 corrects the distortion when it receives image light from the electronic display generated based on the content.

The position sensor 840 is an electronic device that generates data indicating a position of the headset 515. The position sensor 840 generates one or more measurement signals in response to motion of the headset 515. The position sensor 790 is an embodiment of the position sensor 840. Examples of a position sensor 840 include: one or more IMUs, one or more accelerometers, one or more gyroscopes, one or more magnetometers, another suitable type of sensor that detects motion, or some combination thereof. The position sensor 840 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 515 from the sampled data. For example, the IMU integrates the measurement signals received from the accelerometers over time to estimate a velocity vector and integrates the velocity vector over time to determine an estimated position of a reference point on the headset 515. The reference point is a point that may be used to describe the position of the headset 515. While the reference point may generally be defined as a point in space, however, in practice the reference point is defined as a point within the headset 515.

The DCA 845 generates depth information for a portion of the local area. The DCA includes one or more imaging devices and a DCA controller. The DCA 845 may also include an illuminator. Operation and structure of the DCA 845 is described above with regard to FIG. 7A.

The audio system 525 provides audio content to a user of the headset 515. The audio system 525 may comprise one or acoustic sensors, one or more transducers, and the audio controller 540. The audio system 525 may provide spatialized audio content to the user. In some embodiments, the audio system 525 may request a distortion mapping from the HRTF system 200 over the network 510. As described above with regard to FIGS. 5 and 6, the audio system instructs the external speaker 505 to emit test sounds, and captures audio data of the test sounds using a microphone assembly. The audio system 525 calculates a set of initial HRTFs based at least in part on the audio data of the test sound at different orientations of the headset 515. The audio system 525 discards a portion (based in part on at least some of the distortion regions determined by the HRTF server) of the set of initial HRTFs to create an intermediate set of HRTFs. The intermediate set of HRTFs is formed from the non-discarded HRTFs of the set of HRTFs. The audio system 525 generates one or more HRTFs (e.g., via interpolation) that correspond to the discarded portion of the set, which are combined with at least some of the intermediate set of HRTFs to create a set of individualized HRTFs for the user. The set of individualized HRTFs are customized to the user such that errors in the HRTFs caused by wearing the headset 525 are mitigated, and thereby mimic actual HRTFs of the user without a headset. The audio system 525 may generate one or more sound filters using the individualized HRTFs, and use the sound filters to provide spatialized audio content to the user.

The I/O interface 810 is a device that allows a user to send action requests and receive responses from the console 815. An action request is a request to perform a particular action. For example, an action request may be an instruction to start or end capture of image or video data, or an instruction to perform a particular action within an application. The I/O interface 810 may include one or more input devices. Example input devices include: a keyboard, a mouse, a game controller, or any other suitable device for receiving action requests and communicating the action requests to the console 815. An action request received by the I/O interface 810 is communicated to the console 815, which performs an action corresponding to the action request. In some embodiments, the I/O interface 810 includes an IMU that captures calibration data indicating an estimated position of the I/O interface 810 relative to an initial position of the I/O interface 810. In some embodiments, the I/O interface 810 may provide haptic feedback to the user in accordance with instructions received from the console 815. For example, haptic feedback is provided when an action request is received, or the console 815 communicates instructions to the I/O interface 810 causing the I/O interface 810 to generate haptic feedback when the console 815 performs an action.

The console 815 provides content to the headset 515 for processing in accordance with information received from one or more of: the DCA 845, the headset 515, and the I/O interface 810. In the example shown in FIG. 8, the console 815 includes the external speaker 505, an application store 855, a tracking module 860, and an engine 865. Some embodiments of the console 815 have different modules or components than those described in conjunction with FIG. 8. In particular, the external speaker 505 is independent of the console 815 in some embodiments. Similarly, the functions further described below may be distributed among components of the console 815 in a different manner than described in conjunction with FIG. 8. In some embodiments, the functionality discussed herein with respect to the console 815 may be implemented in the headset 515, or a remote system.

The external speaker 505 plays test sounds in response to instructions from the audio system 525. In other embodiments, the external speaker 505 receives the instructions from the console 815, in particular from the engine 865 as described in greater detail below.

The application store 855 stores one or more applications for execution by the console 815. An application is a group of instructions, that when executed by a processor, generates content for presentation to the user. Content generated by an application may be in response to inputs received from the user via movement of the headset 515 or the I/O interface 810. Examples of applications include: gaming applications, conferencing applications, video playback applications, or other suitable applications.

The tracking module 860 tracks movements of the headset 515 or of the I/O interface 810 using information from the DCA 845, the one or more position sensors 840, or some combination thereof. For example, the tracking module 860 determines a position of a reference point of the headset 515 in a mapping of a local area based on information from the headset 515. The tracking module 860 may also determine positions of an object or virtual object. Additionally, in some embodiments, the tracking module 860 may use portions of data indicating a position of the headset 515 from the position sensor 840 as well as representations of the local area from the DCA 845 to predict a future location of the headset 515. The tracking module 860 provides the estimated or predicted future position of the headset 515 or the I/O interface 810 to the engine 865.

The engine 865 executes applications and receives position information, acceleration information, velocity information, predicted future positions, or some combination thereof, of the headset 515 from the tracking module 860. Based on the received information, the engine 865 determines content to provide to the headset 515 for presentation to the user. For example, if the received information indicates that the user has looked to the left, the engine 865 generates content for the headset 515 that mirrors the user's movement in a virtual local area or in a local area augmenting the local area with additional content. Additionally, in some embodiments, responsive to received information that indicates the user has positioned their head in a particular orientation, the engine 865 provides instructions to the external speaker 505 to play a test sound. Additionally, the engine 865 performs an action within an application executing on the console 815 in response to an action request received from the I/O interface 810 and provides feedback to the user that the action was performed. The provided feedback may be visual or audible feedback via the headset 515 or haptic feedback via the I/O interface 810.

The network 510 couples the headset 515 and/or the console 815 to the HRTF system 200. The network 510 may couple additional or fewer components to the HRTF system 510. The network 510 is described in further detail in relation to FIG. 5.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

calculating a set of head-related transfer function (HRTFs) based at least in part on audio data of test sounds captured at different orientations of a headset worn by a user, the set of HRTFs individualized to the user while wearing the headset;

determining a portion of the set of HRTFs to discard using a distortion mapping that identifies one or more distortion regions that are commonly distorted by the headset having a form factor that occludes at least a portion of a face of the user;

discarding the portion of the set of HRTFs to create an intermediate set of HRTFs, the discarded portion corresponding to the one or more distortion regions;

generating one or more HRTFs that correspond to the discarded portion using at least some of the intermediate set of HRTFs;

combining at least some of the intermediate set of HRTFs with the generated one or more HRTFs to create a customized set of HRTFs that are individualized to the user and mimic actual HRTFs of the user without a headset; and providing the customized set of HRTFs to the headset.

2. The method of claim 1, further comprising:

selecting the distortion mapping from a plurality of distorting mappings that are each associated with different physical characteristics, the selecting based in part on physical characteristics of the user.

3. The method of claim 1, further comprising:

measuring a first set of HRTFs with at least one test user wearing a test headset;

measuring a second set of HRTFs with the at least one test user not wearing the test headset; and generating the distortion mapping based in part on comparisons between the first set of HRTFs and the second set of HRTFs.

4. The method of claim 3, further comprising:

updating the distortion with one or more of the customized set of HRTFs.

5. The method of claim 1, wherein the portion of the set to discard includes at least some HRTFs corresponding to orientations of the headset where sound from an external speaker was incident on the headset prior to reaching an ear canal of the user.

6. The method of claim 1, wherein generating the one or more HRTFs that correspond to the discarded portion using at least some of the intermediate set of HRTFs comprises:

interpolating at least some of the intermediate set of HRTFs to generate the one or more HRTFs that correspond to the discarded portion.

7. The method of claim 1, further comprising:

receiving the audio data from the headset, wherein the headset captured the audio data for different orientations of the headset with respect to an external speaker.

8. The method of claim 1, wherein the headset uses the customized set of HRTFs to present spatialized audio to the user.

9. The method of claim 1, wherein the form factor is an eye-wear device or a head-mounted display.

10. A non-transitory computer-readable storage medium storing executable computer program instructions, the executable computer program instructions executed by one or more processors to perform steps comprising:

calculating a set of head-related transfer function (HRTFs) based at least in part on audio data of test sounds captured at different orientations of a headset worn by a user, the set of HRTFs individualized to the user while wearing the headset;

determining a portion of the set of HRTFs to discard using a distortion mapping that identifies one or more distortion regions that are commonly distorted by the headset having a form factor that occludes at least a portion of a face of the user;

discarding the portion of the set of HRTFs to create an intermediate set of HRTFs, the discarded portion corresponding to the one or more distortion regions;

generating one or more HRTFs that correspond to the discarded portion using at least some of the intermediate set of HRTFs;

combining at least some of the intermediate set of HRTFs with the generated one or more HRTFs to create a customized set of HRTFs that are individualized to the user and mimic actual HRTFs of the user without a headset; and providing the customized set of HRTFs to the headset.

11. The non-transitory computer-readable storage medium of claim 10, further comprising executable computer program instructions to perform steps comprising:

selecting the distortion mapping from a plurality of distorting mappings that are each associated with different physical characteristics, the selecting based in part on physical characteristics of the user.

12. The non-transitory computer-readable storage medium of claim 10, further comprising executable computer program instructions to perform steps comprising, further comprising:

measuring a first set of HRTFs with at least one test user wearing a test headset;

measuring a second set of HRTFs with the at least one test user not wearing the test headset; and generating the distortion mapping based in part on comparisons between the first set of HRTFs and the second set of HRTFs.

13. The non-transitory computer-readable storage medium of claim 12, further comprising executable computer program instructions to perform steps comprising:

updating the distortion mapping with one or more of the customized set of HRTFs.

14. The non-transitory computer-readable storage medium of claim 10, wherein the portion of the set to discard includes at least some HRTFs corresponding to orientations of the headset where sound from an external speaker was incident on the headset prior to reaching an ear canal of the user.

15. The non-transitory computer-readable storage medium of claim 10, wherein generating the one or more HRTFs that correspond to the discarded portion using at least some of the intermediate set of HRTFs comprises:

interpolating at least some of the intermediate set of HRTFs to generate the one or more HRTFs that correspond to the discarded portion.

16. The non-transitory computer-readable storage medium of claim 10, further comprising executable computer program instructions to perform steps comprising:

receiving the audio data from the headset, wherein the headset captured the audio data for different orientations of the headset with respect to an external speaker.

17. The non-transitory computer-readable storage medium of claim 10, wherein the headset uses the customized set of HRTFs to present spatialized audio to the user.

18. A head-related Transfer Function (HRTF) system comprising:

one or more processors:

a non-transitory computer-readable storage medium storing executable computer program instructions, the instructions executable by the one or more processors to:

calculate a set of head-related transfer function (HRTFs) based at least in part on audio data of test sounds captured at different orientations of a headset worn by a user, the set of HRTFs individualized to the user while wearing the headset;

determine a portion of the set of HRTFs to discard using a distortion mapping that identifies one or more distortion regions that are commonly distorted by the headset having a form factor that occludes at least a portion of a face of the user;

discard the portion of the set of HRTFs to create an intermediate set of HRTFs, the discarded portion corresponding to the one or more distortion regions;

generate one or more HRTFs that correspond to the discarded portion using at least some of the intermediate set of HRTFs;

combine at least some of the intermediate set of HRTFs with the generated one or more HRTFs to create a customized set of HRTFs that are individualized to the user and mimic actual HRTFs of the user without a headset; and provide the customized set of HRTFs to the headset.

19. The HRTF system of claim 18, wherein the distortion mapping is based in part on comparisons between a set of HRTFs measured with at least one test user wearing a test headset and a set of HRTFs measured with the at least one test user not wearing the test headset.

* * * * *